US010980381B1

(12) United States Patent
Zusy

(10) Patent No.: US 10,980,381 B1
(45) Date of Patent: Apr. 20, 2021

(54) NOZZLE ASSEMBLY FOR VACUUM DEVICE

(71) Applicant: Matthew Zusy, North Royalton, OH (US)

(72) Inventor: Matthew Zusy, North Royalton, OH (US)

( * ) Notice: Subject to any disclaimer, the term of this patent is extended or adjusted under 35 U.S.C. 154(b) by 371 days.

(21) Appl. No.: 16/159,513

(22) Filed: Oct. 12, 2018

Related U.S. Application Data

(60) Provisional application No. 62/571,317, filed on Oct. 12, 2017.

(51) Int. Cl.

| | |
|---|---|
| ***A47L 9/00*** | (2006.01) |
| ***A47L 9/06*** | (2006.01) |
| ***B24B 55/10*** | (2006.01) |
| ***A47L 9/24*** | (2006.01) |

(52) U.S. Cl.
CPC ..... *A47L 9/0072* (2013.01); *A47L 9/062* (2013.01); *B24B 55/10* (2013.01); *A47L 9/24* (2013.01)

(58) Field of Classification Search
CPC ..... A47L 9/0072; A47L 9/062; A47L 9/24; B24B 55/10
See application file for complete search history.

(56) References Cited

U.S. PATENT DOCUMENTS

| | | | | |
|---|---|---|---|---|
| 1,034,260 | A | 7/1912 | Lichtenberg | |
| 2,031,957 | A | 2/1936 | Karlstrom | |
| 2,070,834 | A | 2/1937 | Karlstrom | |
| 2,825,925 | A | 3/1958 | Acheson | |
| 2,858,560 | A | 11/1958 | Bodine, Jr. | |
| 2,951,257 | A | 9/1960 | Bodine, Jr. | |
| 3,481,250 | A | 12/1969 | Toby | |
| 7,437,799 | B2 | 10/2008 | Rocke | |
| 2001/0011404 | A1* | 8/2001 | Roschi | A47L 9/0444 15/387 |
| 2011/0010890 | A1* | 1/2011 | Dimbylow | A47L 9/0613 15/415.1 |
| 2015/0121649 | A1 | 5/2015 | Dever | |
| 2015/0164294 | A1* | 6/2015 | Staf | A47L 5/34 15/347 |

FOREIGN PATENT DOCUMENTS

| | | | |
|---|---|---|---|
| WO | 0209569 | A1 | 2/2002 |

* cited by examiner

*Primary Examiner* — David Redding
(74) *Attorney, Agent, or Firm* — Medley, Behrens & Lewis LLC; Lorri W. Cooper

(57) ABSTRACT

A nozzle assembly for use with a vacuum source includes a base member, a top cover member, a diaphragm, a valve flap and a plurality of springs. The base member has a suction opening extending therethrough. The top cover member enclosing an interior of the nozzle assembly. The diaphragm is rotationally coupled to the base member and includes an opening extending therethrough. The valve flap is rotationally coupled to the diaphragm and covers the opening in the diaphragm. One or more diaphragm springs are positioned between the base member and the diaphragm. One or more valve springs are positioned between the base member and the valve flap. An internal cavity is defined below the diaphragm and above the base member. In operation, pressure forces inside the internal cavity compete with forces associated with atmospheric pressure acting on the valve flap and diaphragm and the force of the diaphragm and valve springs to continuously open and close the valve flap in rapid succession during operation of the vacuum device.

20 Claims, 9 Drawing Sheets

NOZZLE ASSEMBLY FOR VACUUM DEVICE

CROSS-REFERENCE TO RELATED APPLICATION

This application claims priority to U.S. Provisional Application No. 62/571,317, filed on Oct. 12, 2017, the disclosure of which is incorporated by reference in its entirety.

FIELD

The technology described herein relates to a nozzle assembly for use with a vacuum, such as a household vacuum or a wet/dry vacuum, or other device.

BACKGROUND

The "airwatts" of a vacuum device determine how much suction is provided at the suction opening of the appliance through which dirty air and debris is sucked. The suction opening is usually provided at the nozzle end of the vacuum device. In upright vacuums, the suction opening is positioned on a cleaner head mounted directly to the main body of the cleaner. In cylinder cleaners, the suction opening is typically formed in a floor tool that is connected to the main body of the cleaner by a hose. Wet/dry vacuums are similar to cylinder cleaners in that they have a main body with a storage area for collecting dirt and debris, a hose and a suction end. Wet dry vacuums typically have higher airwatts than vacuum cleaners.

Vacuum devices that have high airwatts can exhibit a detrimental effect in that the cleaner head can become "stuck" via suction to the surface being cleaned. This makes it difficult to move the cleaner head across a surface. In addition, some floor coverings have characteristics that result in the development of high friction forces between the floor covering and the cleaner head, regardless of the airwatts. This requires a higher push force by the user to maneuver the cleaner head over the surface, making use of the vacuum device more difficult.

It is known to provide a bleed valve to allow air to be bled into the vacuum device to vary the amount of suction developed at the suction opening. This allows the operation of the vacuum device to be adjusted in response to operating conditions. The bleed valve provides additional airflow through the vacuum device, which reduces the suction developed at the suction opening. This, in turn, reduces the sucking force of the vacuum device onto the surface, which also reduces the forces required to maneuver the cleaner head over the surface to be cleaned. Restoration of airflow through the vacuum device permits dirt and debris to be carried to the storage area of the device.

SUMMARY

A nozzle assembly is disclosed for use with a vacuum device, as shown and described.

BRIEF DESCRIPTION OF THE DRAWING FIGURES

DETAILED DESCRIPTION

Figure 1:
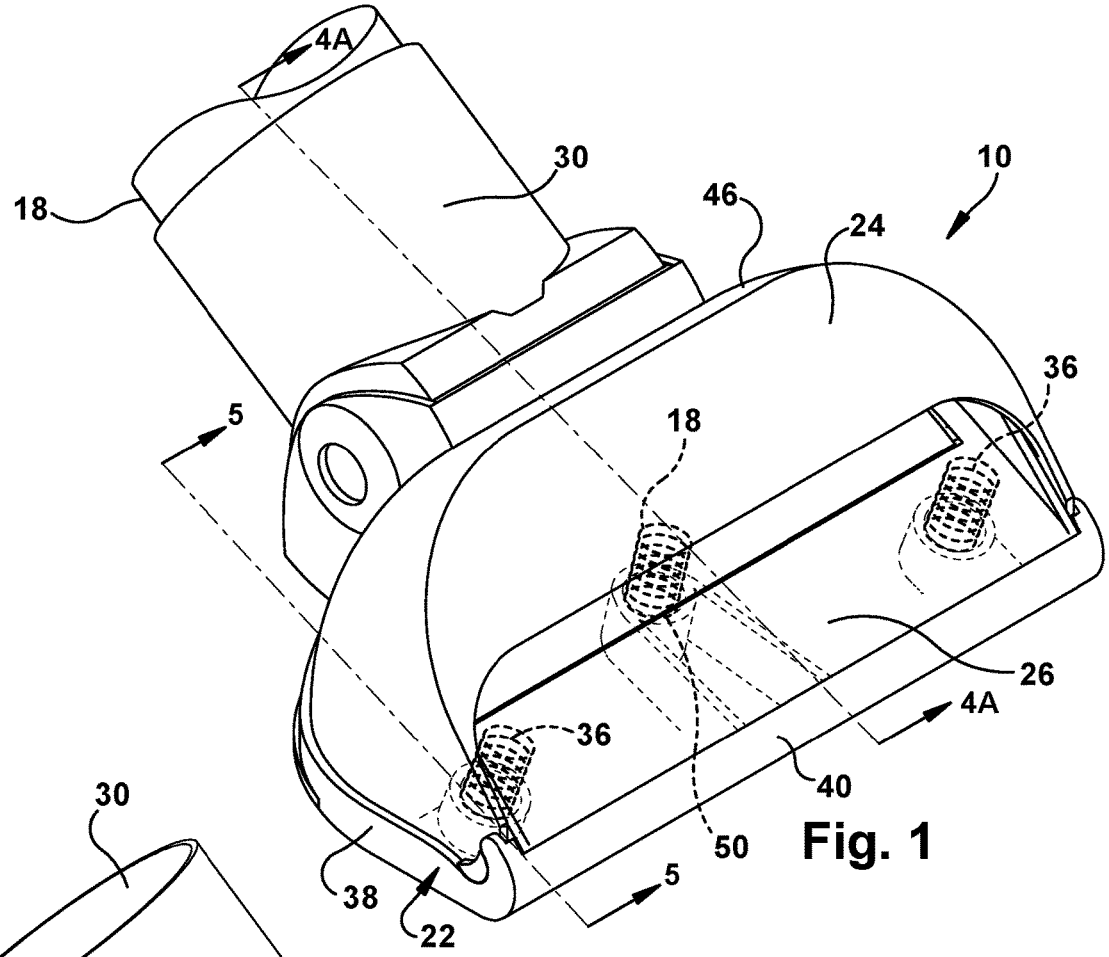
FIG. 1 is a perspective view of a vacuum nozzle assembly according to the invention, with some internal, hidden parts shown in phantom.
Figure 2:
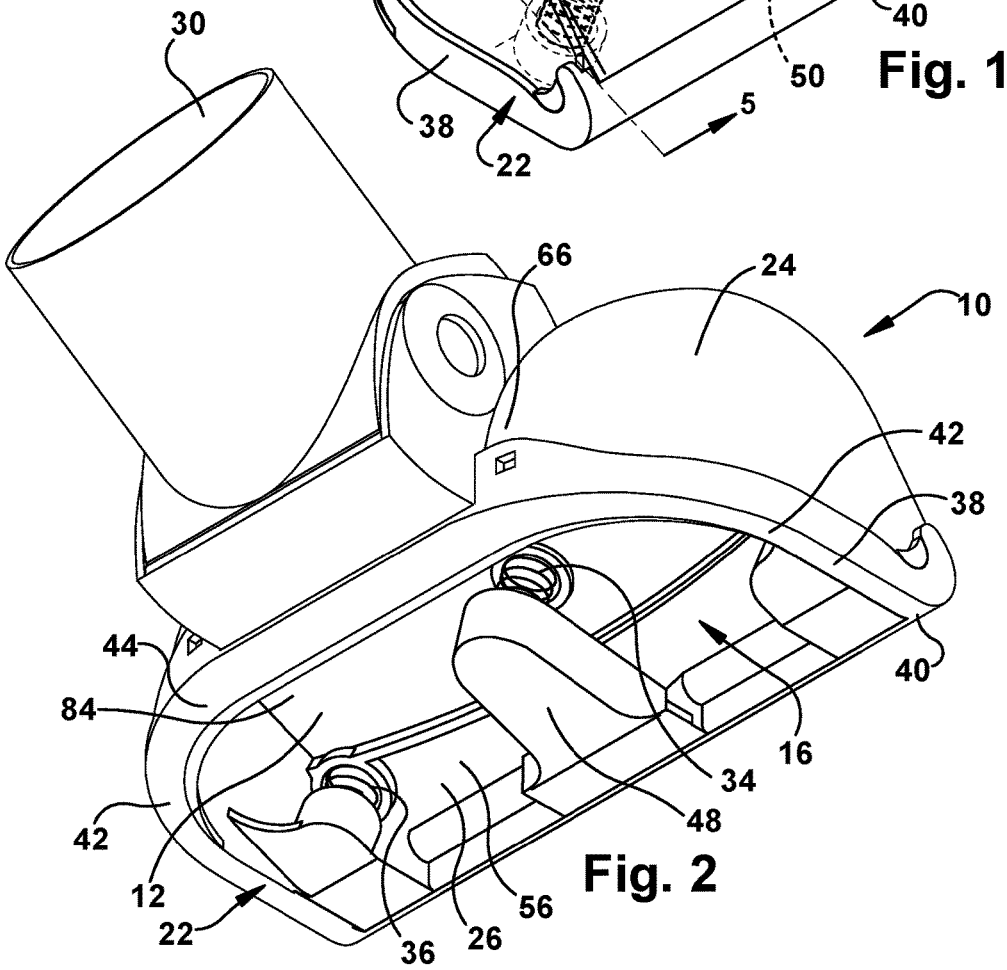
FIG. 2 is a bottom perspective view of the nozzle assembly of FIG. 1.

The technology described herein relates generally to a nozzle assembly 10 for use with a vacuum device. The nozzle assembly 10 is advantageous in that it includes a valve 12 that cycles rapidly between an opened and a closed position without striking the underlying surface 14. The cycling of the valve 12 creates pulsating and vibrating agitation that helps to release dirt from the underlying surface 14. For example, if the underlying surface 14 is a rug, dirt can be trapped between fibers in the rug. Agitation of the rug can result in dirt being released from the fibers. Suction from the vacuum device is then utilized to suck the dirt away from the rug.

The nozzle assembly 10 of the invention may be used as a stand-alone attachment for use with vacuum hoses, or as an integral part of a vacuum device. The nozzle assembly 10 provides a more consistent and powerful vacuum suction because the nozzle is deterred from sticking to an underlying surface 14. The example nozzle assembly 10 also permits the use of more powerful wet/dry vacuums in household settings because the nozzle opening 16 will not get stuck to the underlying surface 14, which typically occurs with a presently known nozzle of wet/dry vacuums.

One type of known vacuum device is an upright vacuum cleaner. This vacuum device typically includes a main body that contains a receptacle for separating dirt and particles from an airflow passing through the vacuum cleaner. This separation can occur through cyclonic technology, or by capturing the dirt and debris in a filtration bag. The main body of the vacuum cleaner is supported by an upstanding support that incorporates a handle that is used to maneuver the vacuum cleaner across a surface 14 to be cleaned. A motor casing is coupled to the main body and houses a motor and a fan unit for drawing dirt-laden air into the vacuum cleaner. Wheels are mounted on the device for allowing maneuverability. A cleaner head is mounted to the device and includes a suction opening 16. The cleaner head is akin to the nozzle assembly 10 of the presently described invention. The suction opening 16 faces the surface 14 to be cleaned. A conduit 18 permits airflow to pass from the suction opening 16 through the main body. The motor draws dirt-laden air into the conduit 18 via the suction opening 16 in the cleaner head or nozzle assembly 10. Air exits the nozzle assembly 10 and flows through the device. The dirt is separated from the air and clean air exits the device through an outlet. In use, the user grasps the handle of the device and moves the nozzle/cleaner head 10 against a surface 14.

Another known type of vacuum device is a cylinder type vacuum cleaner. The cylinder type vacuum cleaner includes a main body that houses a device for separating dirt from air passing through it. The main body includes wheels that permit maneuverability. A cleaner head or nozzle assembly 10 is connected to the main body via a wand and/or hose 18. The wand 18 is typically rigid and the hose 18 is flexible. The nozzle assembly 10 includes a suction opening 16 which communicates directly with the wand and/or hose 18. The wand and/or hose 18 directs the dirt-laden air to the main body where dirt is separated from the airflow and cleaned air exits the main body through an outlet. A motor casing and fan unit are housed in the main body and draw air through the suction opening 16 to the hose 18 to the main body. In use, the user grasps the wand 18 that is attached to the nozzle/cleaner head 10 and maneuvers the nozzle assembly/cleaner head 10 against a surface 14.

Wet/dry vacuums are similar to cylinder vacuums in that they include a main housing that is positioned on wheels that is spaced from the nozzle 10 of the device. Wet/dry vacuums include a large receptacle positioned in the main housing for catching dust and debris, a motor, and a fan. A hose and/or wand 18 are attached to the main housing and a nozzle 10 having a nozzle opening/suction opening 16 is attached to the end of the wand 10 for maneuvering across a surface 14 to be cleaned. The motor and fan pull air through the nozzle opening 16, through the wand and hose 18, and deposit the dirt in the receptacle. Air then exits through a discharge opening in the wet/dry vacuum. In wet/dry vacuums, the motor, fan and discharge opening are typically positioned on a top cover 24 that closes the opening of the receptacle. In use, the user moves the nozzle 10 against a surface 14 to be cleaned, permitting dirt and debris to be sucked through the nozzle opening 16 into the hose 18 and into the receptacle.

The above descriptions of types of vacuum devices relate to known vacuum devices and are provided to show the existing art with respect to vacuum devices that could be utilized with the example nozzle assembly 10 technology described herein. Details of the parts of the vacuum devices not related to the nozzle/cleaner head 10 do not form part of the present invention. The present invention is concerned with the configuration of the nozzle/cleaner head 10 of a vacuum device.

Typical vacuum nozzles/cleaner heads, such as those provided with high powered wet/dry vacuums have operating disadvantages. These nozzles (not shown) typically have a single opening that is associated with the opening in an attached hose or conduit 18. A wand 18 may also be used between the nozzle and the hose 18. Dirt is sucked through the opening in the nozzle into the hose or conduit 18. (For simplicity sake, when the term hose 18 is utilized herein, it can also be interpreted to refer to the term conduit or wand.) These types of nozzles can stick to surfaces or items stick to the suction opening of the nozzle. When the nozzle sticks to a surface 14, it requires the nozzle to be tilted or lifted to break the suction. This often happens with floor mats or rugs, with the mats or rugs being lifted and carried with the suction nozzle. When the nozzle gets stuck, the air flow through the nozzle stops and dirt on the surface 14 of the rug or mat, both around and inside the nozzle, will not be suctioned into the hose 18 and dirt receptacle. A simple bleed valve can help with some of these issues. However, the herein described nozzle assembly 10 provides advantages over the prior art bleed valve and provides for better overall operation of the nozzle assembly 10 with the added benefit of creating agitation without having to slap or hit the underlying surface 14.

The example nozzle assembly 10 includes a valve 12 that automatically opens and closes at a high frequency, creating substantially constant air flow across the surface 14 being cleaned. The opening of the valve 12 provides a period of high air flow which carries dirt away from the surface 14. The closing of the valve 12 provides a period of low flow that ensures that the nozzle assembly 10 will not stick to the underlying surface 14. The opening and closing of the valve 12 at a high frequency creates pulsating air flow on the underlying surface 14 within the area of the nozzle opening 16. This agitation is useful in loosening dirt from the underlying surface 14, such as on carpeting where the pile and backing are pulled and released by the nozzle assembly 10 at a high rate of speed. The opening and closing of the valve 12 within the nozzle assembly 10 creates pulsating air pressure within the interior of the nozzle assembly 10. In addition, the oscillating or moving parts in the nozzle assembly 10 create additional vibration. Dirt that is between carpet fibers is worked free by this vibration and pulsing. Dirt is also impulsively accelerated from the underlying surface 14 by the cycling of the valve 12. From there the constantly moving air along the surface 14 and through the nozzle assembly 10 carries the dirt away.

In present day vacuums, attachments that cause agitation, such as nozzles, often employ a small turbine connected to a rotating drum with brush bristles (not shown). These types of devices are referred to as rotating agitators or cleaners and create agitation by striking the underlying surface 14 in a substantially continuous manner. They typically rotate in one direction, which restricts movement of dirt between the fibers of the underlying surface 14. They are known to get tangled with hair and the like. They also operate in a rotating fashion where they spin on an axis against the surface 14 of the underlying article. Over time, the action of the brush on the surface 14 can cause wear or deterioration of the surface 14, or wear and deterioration to the brush.

The present design creates agitation and vibration of the underlying surface 14 without having to beat or strike the underlying surface 14. While a traditional agitator can be used in combination with the cycling valve 12 of the invention, if desired, the addition of a more traditional agitator may provide additional agitation above and beyond the cycling agitation created by the valve 12.

The movement of the parts associated with the valve 12 can be used as a motor to drive tools, such as additional agitators, brushes, or other functions. For example, the oscillating motion of the parts associated with the valve 12 can be used to move a cleaning device, such as a brush 20. A brush 20 can be coupled to the parts of the valve 12 and can move in a back and forth motion at a high rate of speed that is the same rate of motion of the valve 12 opening and closing. The brush 20 does not rotate, like conventional agitators. Instead, the motion would be translational rather than rotational, which would overcome some present deficiencies with current rotary agitators. This type of motion would provide more effective surface cleaning with less wear to the underlying surface 14. In addition, because the brush 20 would be coupled to the bottom of the nozzle assembly 10, it could be easily removed and replaced.

Referring now to the figures, FIGS. 1-5 depict a first embodiment of the example nozzle assembly 10. The nozzle assembly 10 includes a housing with a base plate 22 or member, a top cover member 24, a diaphragm 26, and a valve flap 12, as shown best in FIG. 3. The base plate 22 forms the lower surface of the nozzle assembly 10 that contacts the underlying surface 14 and that defines the nozzle opening 16. The top cover 24 is positioned on top of the housing and includes an attachment opening 30 for coupling to a hose or wand 18. The base member 22 may also include an attachment opening 30 for coupling to a hose or a wand 18. The top cover 24 and/or base member 22 may have an integral connector 30 for coupling with a hose or wand 18, or could be secured to an additional part, such as an elbow, which is then coupled to the hose or wand 18 in a known manner. When the vacuum device is an upright vacuum, the top cover 24 can include an opening for coupling with an internal conduit 30 of the vacuum device.

An internal cavity 32 is defined inside the nozzle assembly 10 between the base plate 22 and the diaphragm 26 inside the housing. The internal cavity 32 is the area inside the nozzle 10 where pressure from the vacuum source is directed to suck up dirt and debris. The internal cavity 32 is coupled to the exit 30 of the nozzle assembly 10 to permit air and dirt to flow through the internal cavity 32 and out of the nozzle assembly 10.

All the various parts of the nozzle assembly 10 are substantially rigid or completely rigid. The parts may be made of plastic, metal, combinations thereof, or other substantially rigid materials.

In the first embodiment, the valve flap 12 is attached to the diaphragm 26 and the diaphragm 26 is attached to the base plate 22. Both the valve flap 12 and the diaphragm 26 are independently biased by springs 34, 36, which are coupled to the housing. The valve flap 12 is biased to normally open the valve 12. In the closed position, the valve flap 12 rests against a surface of the diaphragm 26 against the force of the biasing spring 36. The diaphragm 26 is biased upwardly in an upper-most position inside the housing and rotates between a lower-most position and an upper-most position.

The base plate 22 includes an outer rim 38 that includes a front edge 40, side edges 42, and a rear edge 44 that together define a central opening 16 in the base plate 22. The front edge 40 is shown as being rounded, but could have other shapes. The central opening 16 is the area of the base plate 22 that dirt is sucked through, also referred to herein as the suction opening or the nozzle opening 16. A rear end of the rear wall includes a recess 30 through which air, dirt and debris can travel through the interior cavity 32 of the nozzle assembly 10 to enter the hose 18. This recess 30 is formed between the base plate 22 rear wall 44 and the rear wall 46 of the top cover 24. A hose attachment or conduit may be associated with this recess 30.

The base plate 22 also includes an arm 48 that extends rearwardly from the front edge 40 in a central area of the front edge 40. The lower surface of the front end 40 of the outer rim 38 and arm 48 are substantially aligned with one another, and the rear end of the arm 48 is elevated relative to the lower surface of the front end 40 of the base plate 22 such that the arm 48 is angled upwardly relative to the lower surface of the base plate 22. The arm 48 is formed as a finger-shaped rib that has a central opening. At the rear end of the arm 48, a receptacle 50 is formed for accepting an end of a coil spring 34, which will be described in greater detail below. In addition, the base plate 22 includes two receptacles 52 that are positioned in the two front corners of the base plate 22, behind the front edge 40. While the arm 48 is shown as being rib-like with a central opening, the arm 48 could also be solid so that air is not permitted to flow through it. The arm 48 could be other shapes other than that shown and could be positioned elsewhere.

The diaphragm 26 is positioned above and rests on the base plate 22 at the front end of the base plate 22. The diaphragm 26 includes a continuous outer wall 54 that surrounds the exterior of the diaphragm 26. The outer wall 54 has a bottom surface 56 that is substantially planar, other than a leading edge 58 of the bottom surface that interacts with the base plate 22 to rotatably couple the base plate 22 and the diaphragm 26 together. The front end of the diaphragm 26 has a shelf 60 that is substantially perpendicular to the bottom surface 56 of the diaphragm 26. This shelf 60 is solid and does not permit airflow therethrough. The rear end of the diaphragm 26 includes an opening 62 therethrough, through which bleed air may travel through the top surface of the nozzle assembly 10 when the opening 62 is not closed off by the valve 12. The diaphragm 26 includes a rear wall 54 that abuts and seats closely against the rear wall 66 of the top cover 24. The shape of the rear wall 54 of the diaphragm 26 is configured to track the shape of the inner side of the rear wall 66 of the top cover 24 such that as the diaphragm 26 rotates inside the top cover 24, the rear wall 54 of the diaphragm 26 remains abutted against the inner side of the rear wall 66 of the top cover 24. Airflow is substantially deterred from flowing between the rear wall 54 of the diaphragm 26 and the rear wall 66 of the top cover 24.

The base plate 22 includes at least one pin 68 and receptacles 70 for accepting the pin 70 on an inner side at a front end 40 of the base plate 22. The diaphragm 26 includes receptacles 70 for accepting the at least one pin 68 of the base plate 22. The receptacles 70 of the diaphragm 26 align axially with receptacles 70 in the base plate 22 such that a pin 68 can be slid through the receptacles 70 to rotatably couple the diaphragm 26 to the base plate 22. The diaphragm 26 pivots relative to the base plate 22 around the at least one pin 68. The rear end 54 of the diaphragm 26 is movable up and down relative to the base plate 22 while the front end 72 of the diaphragm 26 is rotatable around the pin 68, but not movable upwardly or downwardly relative to the base plate 22. Thus, the diaphragm 26 pivots around the pin 68. Other means for providing the diaphragm 26 with pivoting motion can also be used with the invention, as known by those of skill in the art.

Figure 3:
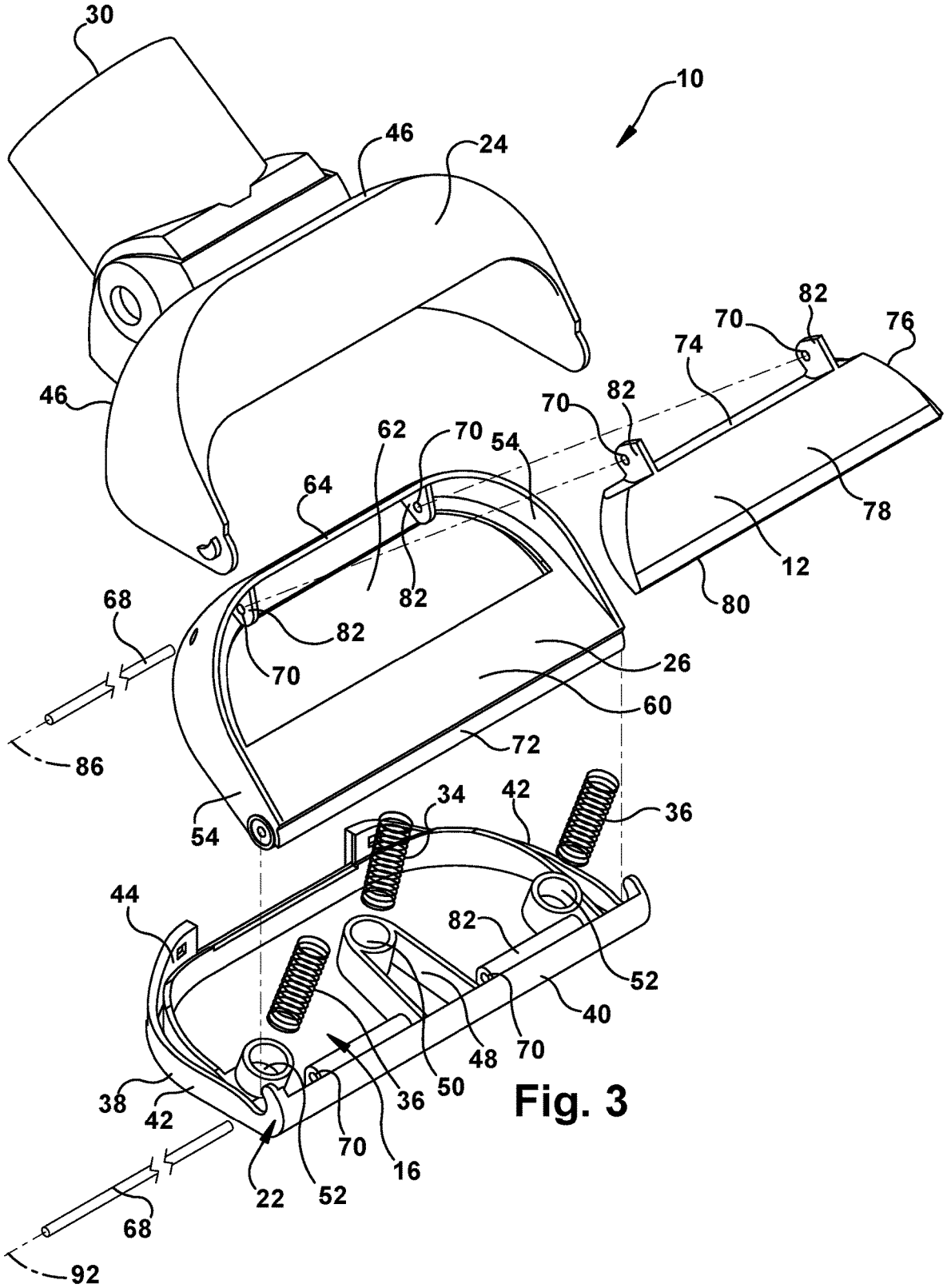
FIG. 3 is an exploded view of the various parts of the device of FIG. 1.

Diaphragm springs 36, such as coil springs, are positioned between the base plate 22 and the diaphragm 26. Two diaphragm springs 36 are shown in FIGS. 1 and 3. The diaphragm springs 36 bias the diaphragm 26 upwardly. An upper surface of the base plate 22 includes upwardly facing receptacles 52 for receiving a lower end of the diaphragm springs 36. A lower surface of the diaphragm 26 includes downwardly facing receptacles 52 for receiving an upper end of the diaphragm springs 36. The springs 36 are trapped between the upper surface of the base plate 22 and the lower surface of the diaphragm 26. The springs 36 may be press-fitted into the receptacles 52 so that they are retained therein by the press-fit. The receptacles 52 are substantially round recesses that form walls for holding one end of the valve spring 34 in place. The springs 36 are positioned on the left and right sides of the base plate 22 and diaphragm 26 and are positioned to extend vertically or substantially vertically. The springs 35 may be angled at an angle relative to the base plate 22 or could be perpendicular to the base plate 22. The diaphragm springs 36 may be positioned at other locations, if desired, or include one or more diaphragm springs 36.

A valve flap 12 is positioned over the opening 62 in the diaphragm 26. The valve flap 12 is sized to entirely cover the opening 62 of the diaphragm 26 to block air flow through the opening 62. The valve flap 12 is solid and includes a rear wall 74, side walls 76, an upper surface 78, and a front edge 80. The diaphragm 26 includes receptacles 52 for accepting a pin 68 therethrough for coupling the valve flap 12 to the diaphragm 26. The receptacles 50 are positioned on an inner side of the rear wall 54 of the diaphragm 26 and are axially aligned with one another. As shown in FIG. 3, the receptacles 50 may be formed through tabs 82 that extend inwardly from the rear wall 54 of the diaphragm 26. The valve flap 12 includes complementary receptacles 50 that are axially aligned for accepting the pin 68 therethrough. The receptacles 50 are shown as being substantially round openings.

The receptacles 50 on the valve flap 12 are positioned on a rear wall 74 of the valve flap 12 and are positioned on tabs 82 that extend rearwardly from the rear wall 74 of the valve flap 12. The tabs 82 on the rear side 74 of the valve flap 12 align with tabs 82 on the rear wall 54 of the diaphragm 26 and a pin 68 may be slid through the receptacles 70 to rotationally couple the valve flap 12 to the diaphragm 26. The valve flap 12 includes an upper surface 78 and a lower surface 84. The lower surface 84 of the valve flap 12 includes a recess 50 for accepting an upper end of a valve spring 34, such as a coil spring. The finger-like rib 48 of the base plate 22 includes a recess 50 for holding the lower end of the valve spring 34. The valve spring 34 biases the valve flap 12 upwardly, into an open position where the valve flap 12 is not seated on the diaphragm 26.

The area under the base plate 22 and diaphragm 26 creates an interior or inner chamber or cavity 32. When the valve 12 is closed, dirt and debris travel through the nozzle opening 16 of the base plate 22 into the interior or inner chamber 32, through the rear 30 of the nozzle assembly 10 via vacuum flow and into the hose 18.

Operation is as follows: when the suction opening 16 of the nozzle assembly 10 is applied to a surface 14, the suction opening 16 becomes constricted. This creates negative pressure inside the inner chamber 32, creating a partial vacuum. The vacuum creates a reduction in pressure that permits the atmospheric pressure present on the outer surface of the diaphragm 26 to move the diaphragm 26 downwardly. The vacuum acts upon the inner side 56 of the diaphragm 26 in the inner chamber 32 while atmospheric pressure communicates with the outer facing side of the diaphragm 26. The differential of total pressures overcomes the diaphragm springs 36 so that the diaphragm 26 moves downwardly inside the inner chamber 32. As the diaphragm 26 moves downwardly, the valve flap 12 acts upon the valve spring 34 and further compresses it. When the atmospheric pressure acting on the valve 12 is less than the pressure exerted on the valve 12 by the valve spring 34, the valve flap 12 will open, allowing atmospheric pressure to enter the inner chamber 32 and releasing the vacuum created on the underlying surface 14. When atmospheric pressure is approached or reached inside the inner chamber 32, the pressure on the upper and lower sides of the diaphragm 26 and valve 12 are substantially neutralized, which permits the spring force of the diaphragm springs 36 to overcome the differential of forces acting on the diaphragm 26 so that the diaphragm 26 moves upwardly to its first position. At the same time, atmospheric pressure acting on the external side 78 of valve flap 12 exerts pressure on the valve flap 12 and the valve spring 34 elongates as the diaphragm 26 moves upwardly, providing for less force on an inner side 84 of the flap 12. When the pressure differential exceeds the strength of the valve spring 34, the valve flap 12 closes and returns to the first position.

Figure 4A:
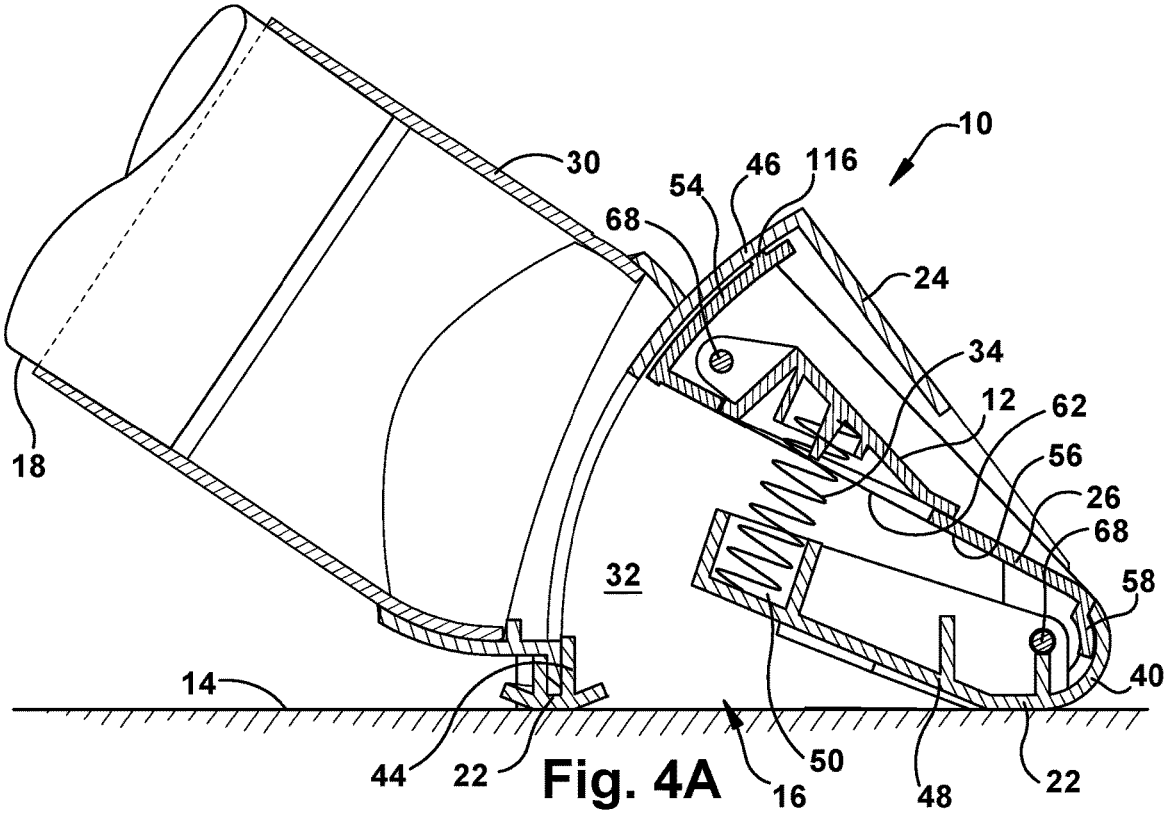
FIG. 4A is cross-sectional side view of the device of FIG. 1 taken along line 4A-4A in FIG. 1, showing the device in a first operational position where the valve is closed.
Figure 4B:
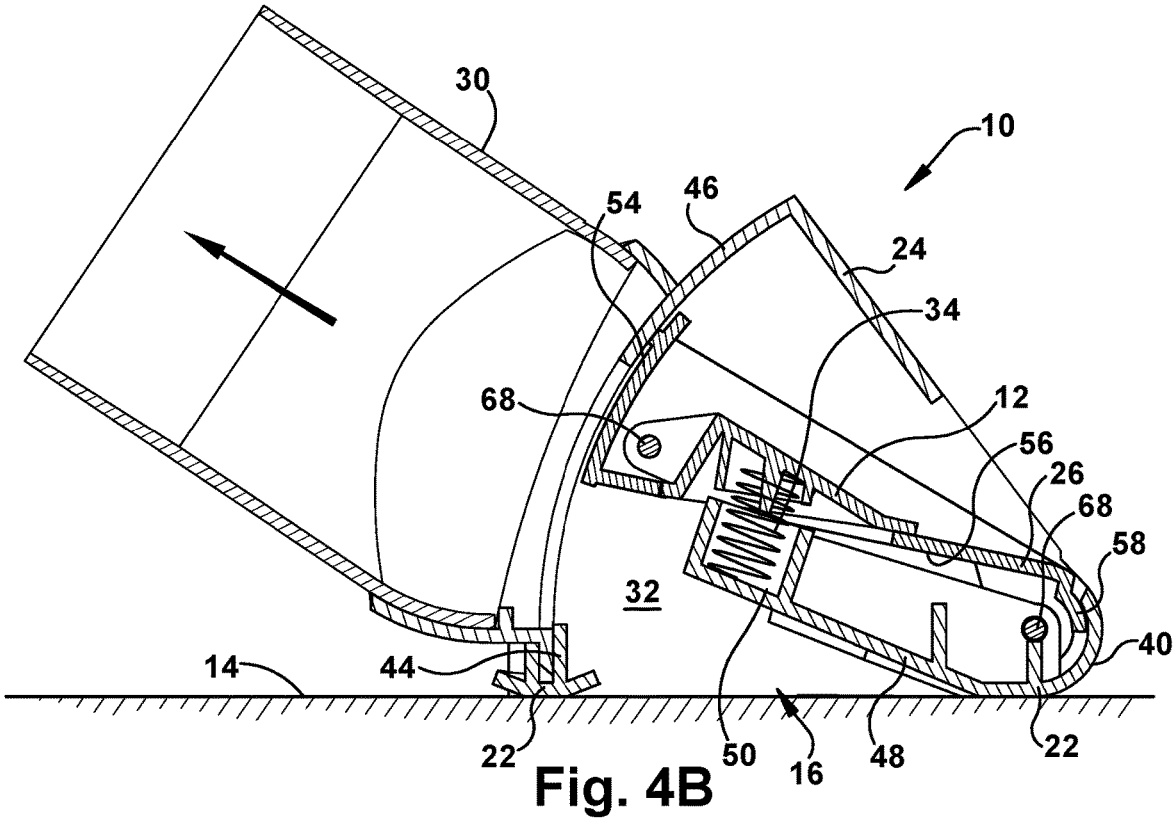
FIG. 4B is a cross-sectional side view of the device of FIG. 1 taken along line 4A-4A in FIG. 1, showing the device in a second operational position where the valve is closed.
Figure 4C:
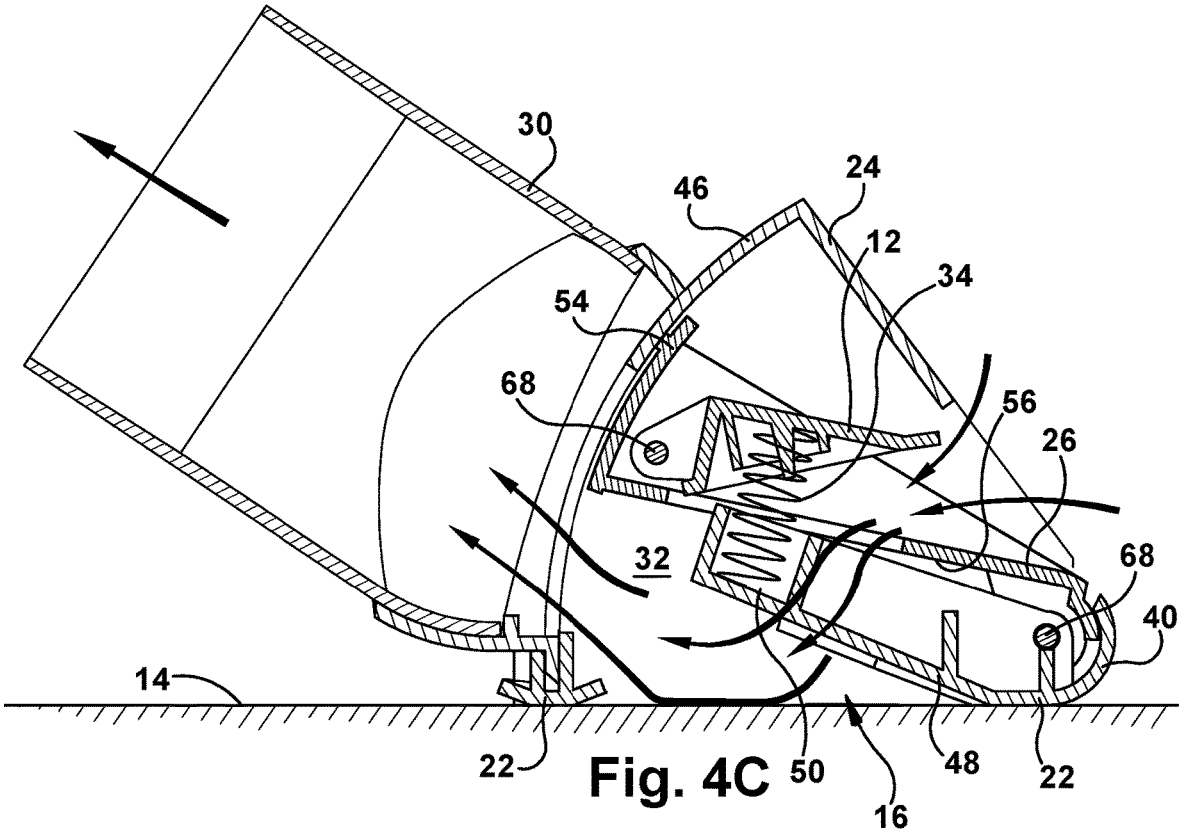
FIG. 4C is a cross-sectional side view of the device of FIG. 1 taken along line 4A-4A in FIG. 1, showing the device in a third operational position, where the valve is open.

FIGS. 4A-4C depict the operation of the nozzle assembly 10, including a depiction of how the valve 12 cycles open and closed, or oscillates, to cause vibration and agitation of the underlying surface 14. In operation, when the nozzle assembly 10 is placed on a surface 14 to be cleaned, such as shown in FIG. 4A, air enters through the nozzle opening 16 and flows through an internal cavity 32 of the nozzle assembly 10 through the rear 30 of the nozzle assembly 10 to the vacuum device. An intermittent seal is created between the suction opening 16 of the base plate 22 and the underlying surface 14. This prevents normal airflow through the nozzle assembly 10 and creates a vacuum. As the flow of air through the internal cavity 32 decreases, the suction generated by the motor and fan of the vacuum device continues to draw a vacuum. As negative pressure builds inside the internal cavity 32, the diaphragm 26 moves downwardly against the force of the diaphragm springs 36. This results in negative air pressure within the inner chamber 32 of the nozzle assembly 10. As the pressure decreases inside the inner chamber 32, atmospheric air pressure acts on the outer surface 54 of the diaphragm 26 and the attached valve flap 12, aiding in the rotation of the diaphragm 26 around the pin 68 to the second position, shown in FIG. 4B.

As shown in FIG. 4B, the atmospheric pressure on the valve flap 12 maintains the valve 12 in a closed, or second position as it rotates along with the diaphragm 26 against the force of the valve spring 34. When the valve spring 34 force overcomes the atmospheric air pressure force on the upper surface 78 of the valve flap 12, the valve 12 begins to open, rotating around the valve axle 86, as shown in FIG. 4C, to the third position. As the valve 12 opens to the third position, atmospheric air travels from outside the nozzle assembly 10 through the valve opening 62 in the diaphragm 26 and enters the inner chamber 32 of the nozzle assembly 10. The force of the valve spring 34 decreases as it opens the valve 12, but the atmospheric air pressure force on the valve flap 12 decreases at a more significant rate. This allows the valve spring 34 to fully open the valve 12. The relief air is suctioned into the vacuum device through the opening 62 in the diaphragm 26. The relief air that enters through the valve opening 62 breaks the seal between the base plate 22 and the underlying surface 14, which restores suction pressure within the inner chamber 32 of the nozzle assembly 10 so that dirt and debris can again be suctioned through the nozzle opening 16 into the internal cavity 32. When the valve 12 is opened, the air pressure in the inner chamber 32 rises, which allows the diaphragm springs 36 to reset the diaphragm 26 and the valve 12 to the starting, or first position, shown in FIG. 4A.

Figure 5:
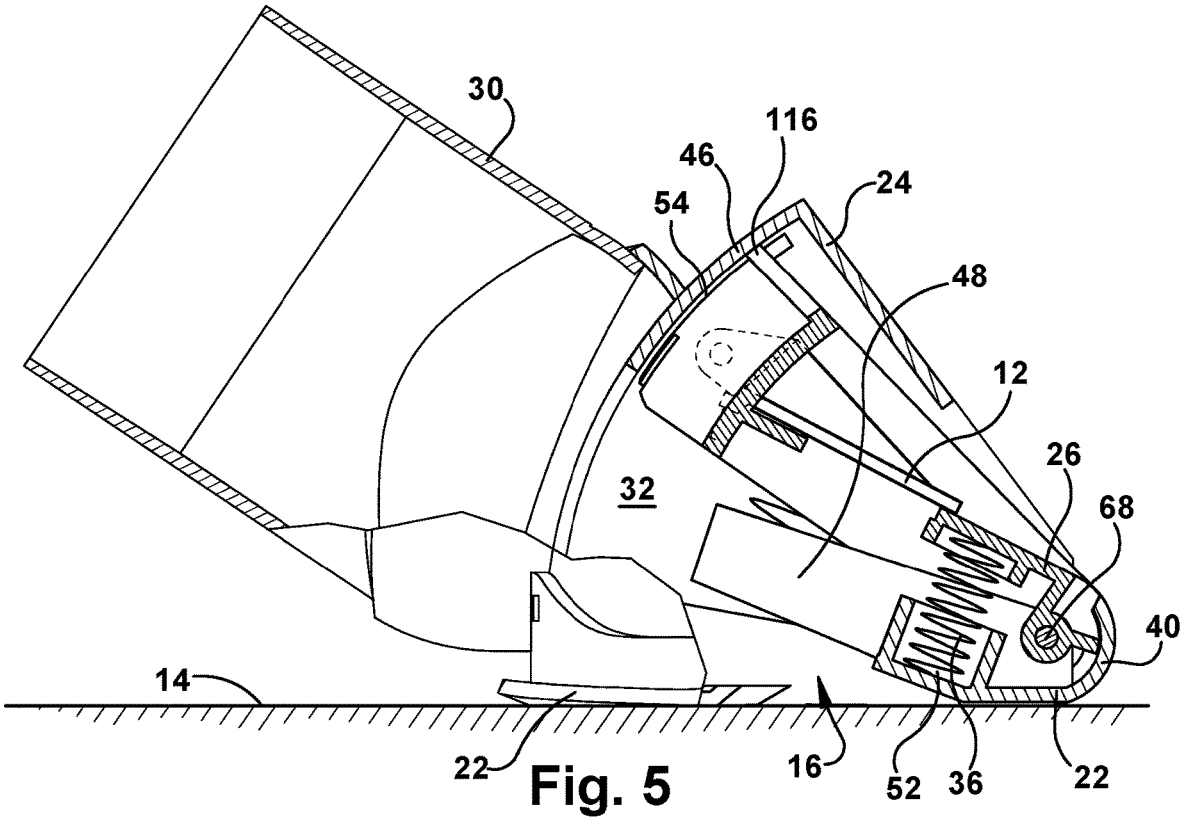
FIG. 5 is a cross-sectional side view of the device of FIG. 1, taken along line 5-5, with the device in an operational position as shown in FIG. 4A.

FIG. 5 depicts the operation of the diaphragm springs 36 while FIGS. 4A-4C depict the operation of the valve spring 34. FIG. 5 depicts the diaphragm 26 in the first position, prior to be the base plate 22 being substantially sealed against the underlying surface 14.

The relative forces on the diaphragm 26 and valve flap 12 can be calculated to ensure that the nozzle valve 12 operates properly. The surface area of the diaphragm 26 relative to the surface area of the valve flap 12 determines the proportion of forces against the springs 34, 36. A larger surface area of the valve flap 12 requires a larger valve spring 34 force to open the valve 12. In addition, the leverage force of the springs is determined by spring location relative to the axis of rotation of the respective part. Other parameters that are relevant to the proper operation of the nozzle assembly 10 include the stiffness of the springs 34, 36 (e.g., spring constant), the size of the inner suction chamber 32, the size of the valve opening 62, the weight/mass of the valve flap 12 and diaphragm 26, the size of the nozzle assembly 10, and the length of the stroke of the diaphragm 26, among other considerations.

An imbalance of air pressures occurs in the housing between the diaphragm 26 and the atmosphere outside the housing when the diaphragm opening 62 is closed or partially closed. This difference in pressures causes the diaphragm 26 and included valve flap 12 to move downwardly. In addition, a difference exits in the surface area of the diaphragm 26 depending upon whether the valve flap 12 covers the opening 62 in the diaphragm, or if the valve flap 12 is in an open position. The surface area of the diaphragm 26 is determined based upon the size of the diaphragm 26. The surface area of the opening 62 in the diaphragm 26 is determined by the size of the opening 62. When the valve flap 12 completely closes the opening 62, the surface area of the diaphragm 26 is the entire surface area of the diaphragm 26, or a first surface area. When the valve flap 12 partially closes the opening 62, the surface area of the diaphragm 26 is the first surface area minus the size of the opening 62. When the valve flap 12 is in an open position, the surface area of the diaphragm 26 equals the first surface area minus the surface area of the opening 62. The surface area of the diaphragm 26 when in the open and closed positions plays an important role in the movement of the diaphragm 26. When the valve flap 12 is open, the inner and outer air pressures begin to equalize. More significantly, the surface area of the combined diaphragm 26 and valve flap 12 is reduced. The rise in air pressure within the internal chamber 32 occurs over a longer period of time than the time it takes to reduce the surface area. Thus, the change in surface area is important to the movement of the diaphragm 26 because it occurs very quickly and, oftentimes, more quickly than the change in pressure.

In yet another embodiment, a nozzle assembly for use with a vacuum device includes a housing, a diaphragm, and a valve flap. The housing has a suction opening in communication with an inner chamber defined in the housing. The diaphragm is movably positioned inside the housing in the vicinity of the inner chamber. The diaphragm has a first surface area defined by an outer perimeter of the diaphragm. The diaphragm has an opening extending therethrough for communicating air from the inner chamber to the atmosphere around the housing. A perimeter of the opening defines a second surface area. The valve flap is coupled to the diaphragm and has a surface area at least large enough to entirely close the opening in the diaphragm. The valve flap is movable between an open and closed position to open and close the opening in the diaphragm. The diaphragm has the first surface area when the valve is closed and a third surface area equal to the first surface area minus the second surface area when the valve is open. Movement of the diaphragm and valve flap inside the housing is caused by a combination of an imbalance in air pressures between the internal chamber and the atmosphere surrounding the housing, and the change in surface area between the first surface area and the third surface area.

The valve flap may alternatively have a surface area to at least in part cover the opening in the diaphragm, such that the valve flap may not entirely cover the opening in the diaphragm. The valve flap is movable between an open and closed position to open and partially or fully close the opening in the diaphragm. The vacuum can still pick up dirt and debris even if the opening through the diaphragm is not completely covered as long as the vacuum force is great enough to operate the valve.

Figure 6A:
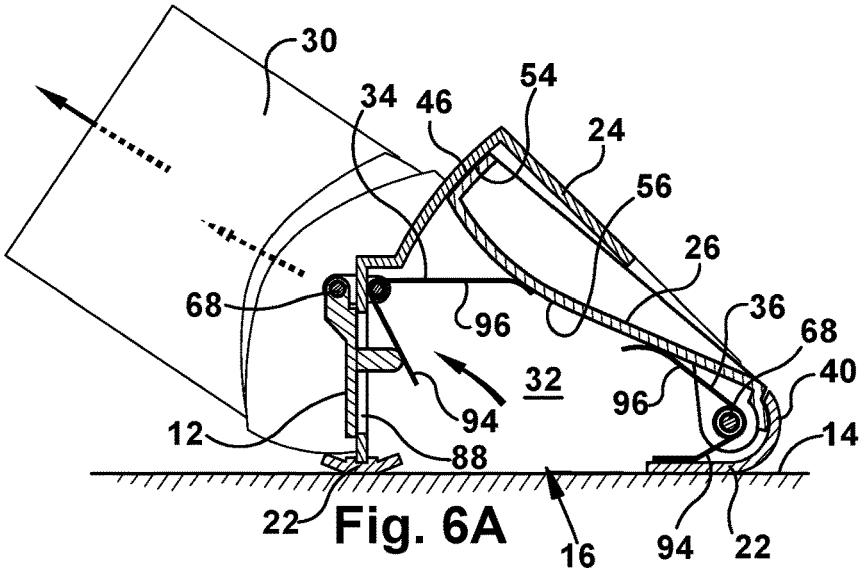
FIG. 6A is cross-sectional side view of an alternative vacuum nozzle assembly similar to that shown in FIG. 1, with the device in a first operational position.
Figure 6B:
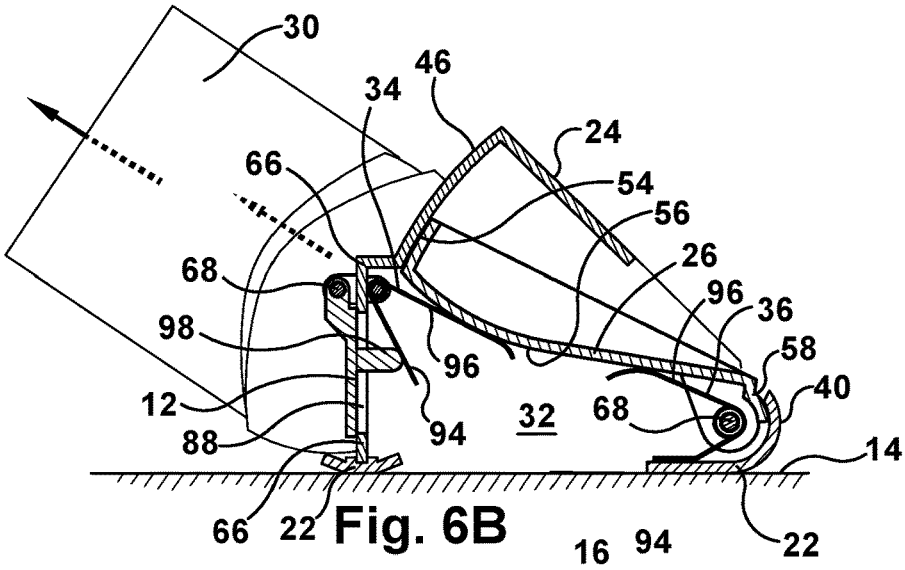
FIG. 6B is a cross-sectional side view of the embodiment of FIG. 6A, with the device in a second operational position.
Figure 6C:
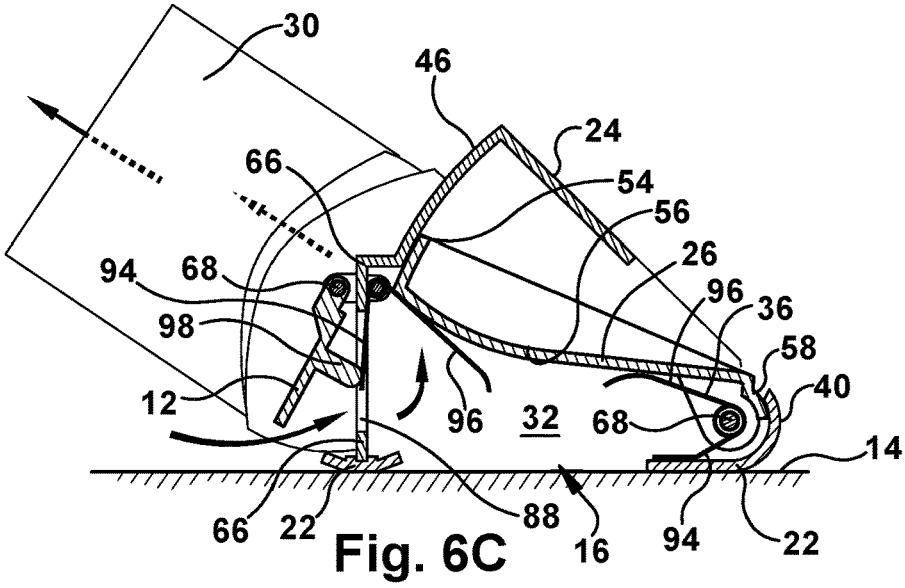
FIG. 6C is a cross-sectional side view of the embodiment of FIG. 6A, with the device in a third operational position, where the valve is open.
Figure 8:
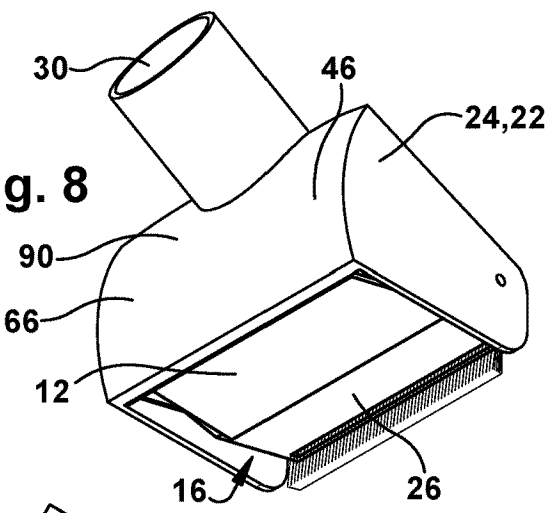
FIG. 8 depicts a perspective bottom view of the embodiment of FIG. 7.
Figure 7:
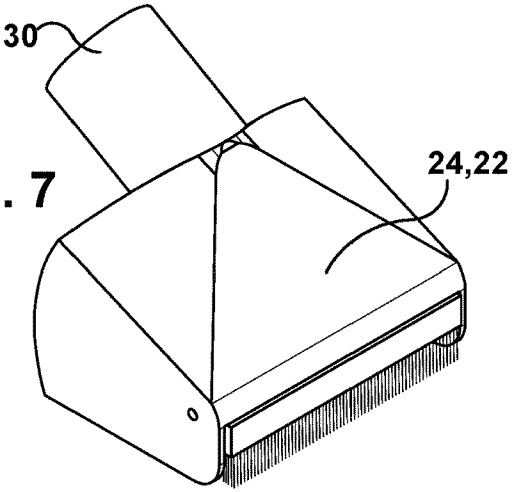
FIG. 7 depicts a top perspective view of an alternative embodiment of the vacuum nozzle assembly according to the invention, where the nozzle assembly includes a brush that sweeps linearly based upon the action of the valve.

In the embodiment shown in FIGS. 1-5, the valve flap 12 is shown as being positioned within or on top of an opening 62 in the diaphragm 26. A second embodiment, as shown in FIGS. 6A-6C, depicts that the valve 12 could, alternatively, be attached to an opening 88 in the housing instead of the diaphragm 26. The nozzle assembly 10 shown in FIGS. 6A-6C is similar in many respects to the embodiment of FIGS. 1-5, but shows the valve 12 being positioned on a rear wall of the nozzle assembly 10. The valve flap 12 continues to communicate with the movement of the diaphragm 26 via a torsion spring. The nozzle assembly 10 of the second embodiment includes a base member 22, a top cover 24, a diaphragm 26, and a valve flap 12. The valve flap 12 seats over the opening 88 in the housing. As shown, the opening 88 is positioned in a rear wall 90 of the housing. The springs 34, 36 shown in this embodiment are torsion springs that are rotatably coupled at or near the points of rotation of the various parts. In addition, the diaphragm 26 is normally biased to a first, upper position, as shown best in FIG. 6A.

The base member 22 includes external walls 38 that surround a nozzle suction opening 16. The front end 40 of the base member 22 is rounded and the bottom surface of the base member 22 is substantially planar to abut an underlying surface 14. The top cover 24 includes a rear wall 90 that has an opening 30 that leads to the hose 18 and an opening 88 that accepts the valve 12, permitting atmospheric air to enter the internal chamber 32 of the nozzle assembly 10. The rear wall 90 of the top cover 24 abuts and is coupled to the rear end 44 of the base member 22. Part of the rear wall 90 of the top cover 24 is shown as being substantially perpendicular to the bottom surface of the base member 22, but could be positioned at an angle relative to the bottom surface, if desired.

The diaphragm 26 is positioned between the top cover 24 and the base member 22 and is solid, without any openings extending therethrough. The diaphragm 26 is rotatably coupled to the front end 40 of the base member 22 via receptacles 70 and pins 68 that form a rotational axle 92 for the diaphragm 26, as previously described above in connection with FIGS. 1-5. A torsion spring 36 is coupled to the diaphragm axle 92, with the lower arm 94 of the torsion spring abutting an upper surface of the base member 22 and the upper arm 96 of the torsion spring abutting a lower surface 56 of the diaphragm 26. The diaphragm spring 36 pushes upwardly on the diaphragm 26.

A valve flap 12 is positioned on the outer surface of the rear wall 90 of the top cover 24 and completely covers the valve opening 88 in the rear wall 90 of the top cover 24. The valve flap 12 is rotationally coupled to the rear wall 90 of the top cover 24 via an axle 86 that is positioned rearwardly of the rear wall 90. The valve flap 12 is biased to close the opening 88 in the rear wall 90 of the top cover 24. Any type of spring, such as a torsion spring, may be used to bias the valve flap 12 closed. The axle 86 is created by a pin 68 that extends through receptacles 70, as explained above in connection with FIGS. 1-5. The valve 12 includes an inwardly extending finger 98 that is positioned on an inner side of the valve 12. A torsion spring 34 is coupled to an inner side of the rear wall 90 via a pin 68 or other attachment member, as known by those of skill in the art. An upper arm 96 of the torsion spring abuts a lower surface 56 of the diaphragm 26 at a rear end 54 of the diaphragm 26. A lower arm 94 of the torsion spring abuts the finger 98 of the valve flap 12.

As shown, the rear end 54 of the diaphragm 26 is rotatable upwardly and downwardly relative to an inner surface of the top cover 24. A rear wall 54 of the diaphragm 26 abuts the inner surface of the top cover 24 in close proximity so that air flow is substantially prevented from flowing between the diaphragm 26 and the inner surface of the top cover 24. A seal 116 is positioned on an outer surface of the rear wall of the diaphragm 26 and aids in preventing flow between the diaphragm 26 and the wall 46 of the to cover.

The valve flap 12 is coupled to an exterior rear wall 90 of the nozzle assembly 10 and is positioned below the connection point of the valve flap 12. The valve flap 12 rotates in and out. At its inner-most position, the valve opening 88 is closed. At its outer-most position, the valve opening 88 is open, permitting atmospheric air to enter the internal cavity 32.

The diaphragm 26 motion mechanically opens the valve flap 12, which raises the internal pressure in the nozzle assembly 10 internal cavity 32 and which allows the valve flap 12 to reset to closed. To create the cycling action, the diaphragm 26 is pulled downwardly against the force of the diaphragm spring 36, by the suction created inside the internal cavity 32 of the nozzle assembly 10. The diaphragm 26 rotates about the diaphragm axle 92 at the front end of the nozzle assembly 10 such that only the rear end 54 of the diaphragm 26 moves up and down. As the rear end 54 of the diaphragm 26 moves downwardly, it presses on the valve spring 34, which exerts pressure on the finger 98 of the valve 12. When the atmospheric pressure on the outer surface of the valve flap 12 become lower than the force applied on the finger 98 by the valve spring 34, the valve flap 12 will open. When the valve flap 12 opens, the pressure inside the inner chamber 32 approaches atmospheric pressure and releases any suction created between the nozzle opening 16 and the underlying surface 14. This, in turn, permits the diaphragm 26 and valve flap 12 to move to their first positions. The valve 12 location can be anywhere on the housing as long as there is a mechanical connection between the valve 12 and the diaphragm 26.

FIG. 6A depicts the valve flap 12 in a closed first position with air being sucked through the nozzle assembly 10 into the hose 18 and the diaphragm 26 in an uppermost position. In this position, the nozzle assembly 10 becomes suctioned onto the underlying surface 14. This results in decreasing pressure inside the inner chamber 32 and causes the diaphragm 26 to move downwardly inside the top cover 24 to the second position. This, in turn, acts on the valve torsion spring to push the spring downwardly against the valve flap 12 finger to compress the valve spring 34, as shown in FIG. 6B. As the diaphragm 26 continues to move downwardly, the force of the valve spring 34 against the valve flap 12 overcomes the spring that biases the valve flap 12 closed and the valve flap 12 opens, permitting atmospheric air to enter the inner chamber 32 and increasing the air pressure inside the inner chamber 32. This permits the diaphragm spring 36 to push the diaphragm 26 upwardly to the first position and the cycle continues.

FIGS. 7-9C depict an alternative embodiment of the nozzle assembly 10 where the rotating parts are used to operate a brush 20. In this embodiment, the inner chamber 32 of the nozzle assembly 10 is always in a closed/sealed state, thus any vacuum will cause the cycling action described above. The passage of the dirt being vacuumed now goes through the valve 12, which neither of the prior embodiments disclosed. The third embodiment of the nozzle assembly 10 includes a housing that defines a top surface and a rear surface 90, as well as a recess or opening 30 for accepting a hose or a wand 18. A diaphragm 26 is rotatably coupled to the lower side of the top surface at the front end thereof. The valve 12 is rotatably coupled to a lower side 56 of the diaphragm 26 at a rear end 54 of the diaphragm 26.

Figure 9C:
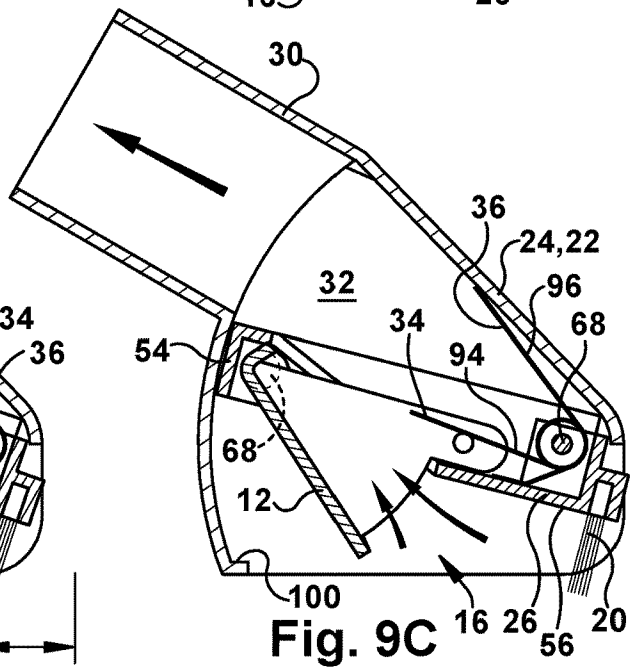
FIG. 9C depicts a cross-sectional side view of the device of FIG. 7, shown in a third operational position where the valve is open.
Figure 9B:
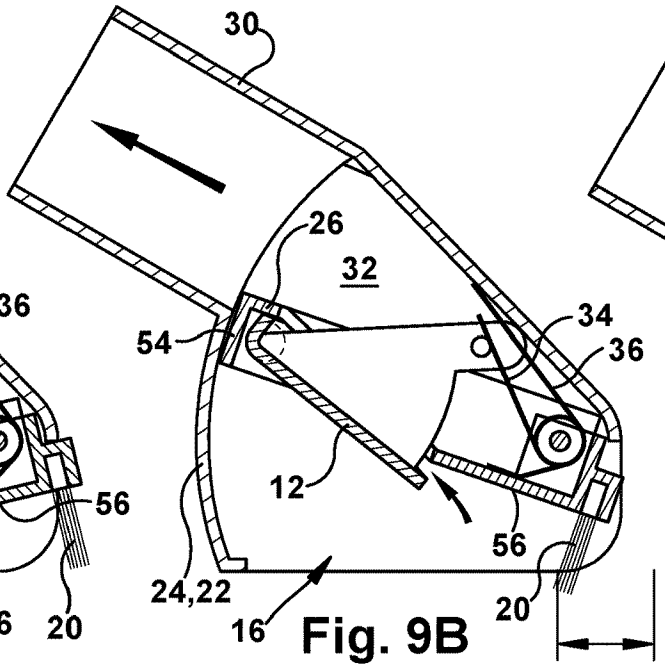
FIG. 9B depicts a cross-sectional side view of the device of FIG. 7, shown in a second operational position.
Figure 9A:
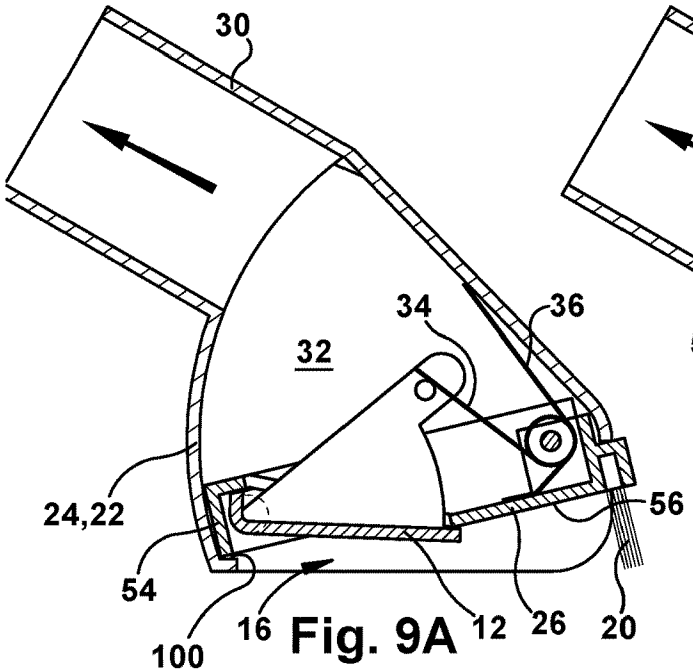
FIG. 9A depicts a cross-sectional side view of the device of FIG. 7, shown in a first operational position.

In a closed position, an upper surface of the valve 12 abuts a lower side 56 of the diaphragm 26. One end of the diaphragm 26 is rotatably coupled to the front end of the top cover 24 and rotates between a closed, first position where the rear end 54 of the diaphragm 26 abuts the inner rear wall 90 of the top cover 24 against a stop 100, and an open position where the diaphragm 26 is at a position that is rotated upwardly relative to the first position. The principles of operation for the device shown in FIGS. 7-9C are the same as those shown in the prior two embodiments. In this embodiment a brush 20 is coupled to a front end of the diaphragm 26. As the diaphragm 26 rotates between the first, second and third positions, as shown in FIGS. 9A-9C, the brush 20, which is fixed to the front end of the diaphragm 26 sweeps back and forth against a surface on which the nozzle opening 16 seats. The movement of the brush 20 has a sweep stroke, shown in FIG. 9B, that is consistent with the movement of the diaphragm 26.

In this embodiment, the top cover 24 permits atmospheric air to enter under the diaphragm 26. As the pressure changes because of the valve 12 being closed, the diaphragm 26 moves upwardly until the torsion spring 34 that abuts the valve flap 12 overcomes the force of the spring that normally biases the valve flap 12 closed. When the valve flap 12 opens, it permits air to enter the rear end 30 of the nozzle assembly 10 and be suctioned through the suction hose or wand 18.

Figure 10A:
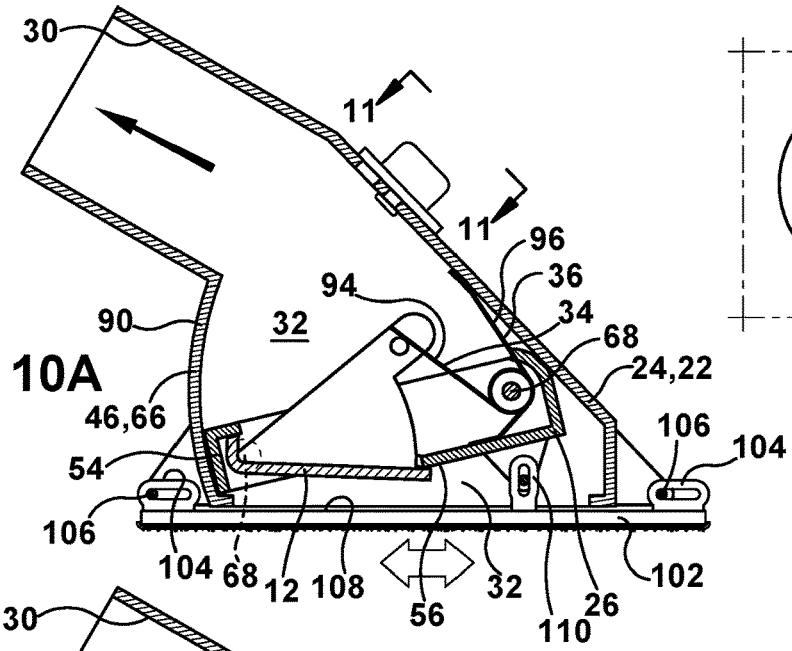
FIG. 10A depicts a cross-sectional side view of an alternative embodiment of the device, where the device is used as a sander attachment to a vacuum device, with the device in a first operational position.
Figure 10B:
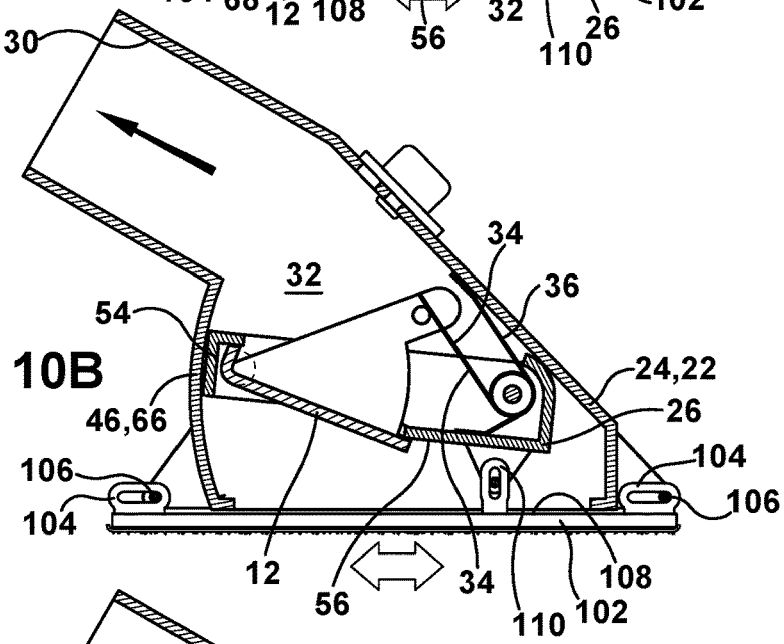
FIG. 10B depicts a cross-sectional side view of the device of FIG. 10A, with the device in a second operational position.
Figure 10C:
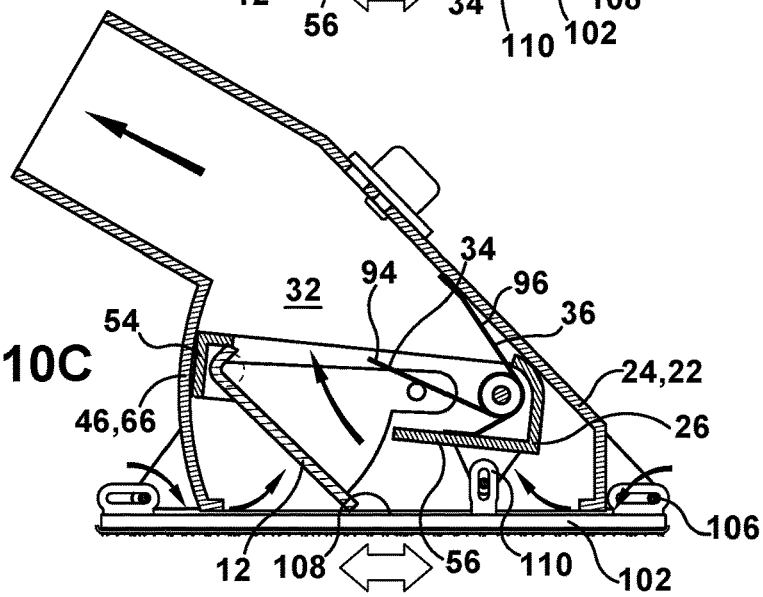
FIG. 10C depicts a cross-sectional side view of the device of FIG. 10A, with the device in a third operational position where the valve is open.

FIGS. 10A-10C depict an alternative embodiment where the inventive nozzle assembly 10 may be optionally used to drive a sanding pad 102 that is attached to the nozzle assembly 10. This embodiment is similar to the embodiment shown in FIGS. 7-9C, but includes a sanding pad 102 positioned below the housing. This embodiment permits the sanding debris to be sucked into the vacuum as the sanding occurs. Typical sanding devices that attach to vacuum cleaners are powered by a user or by an electric motor. With the present design, an attached sanding pad 102 can be driven back and forth (translational motion) by the motion of the diaphragm 26 while the airflow removes the dust and debris that is created by the sanding motion.

The sanding motion is created by the cycling of the valve 12 from a closed to an opened position and vice versa. The sanding pad 102 is coupled to the diaphragm 26, which moves back and forth as the valve cycles. The sanding pad 102 includes slots 104 that are positioned at the front and rear corners of the sanding pad 102. The top cover 24 of the nozzle assembly 10 includes outwardly extending pins 106 that mate with the slots 104 of the sanding pad 102 and the sanding pad 102 rides on the pins 106 via the slots 104 formed on the sanding pads 102. A top surface 108 of the sanding pad 102 includes an arm 110 that reaches upwardly to couple with the diaphragm 26. The motion of the diaphragm 26 moves the sanding pad 102 back and forth (e.g., forward and rearwardly), permitting the sanding pad 102 to move back and forth relative to the housing. As the diaphragm 26 moves forward and backward as the valve 12 opens and closes, the sanding pad 102 moves forward and backward to sand the underlying surface 14. Air is suctioned under the nozzle assembly 10 into the inner chamber 32 of the nozzle assembly 10 and is carried away by the hose or wand 18. The nozzle assembly 10 of this embodiment provides linear back and forth motion of the sanding pad 102. Because a separate motor is not be required to drive the sander, the weight of the sanding device can be made much lower than conventional hand-held power sanders.

Figure 11:
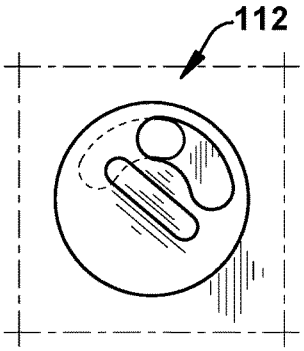
FIG. 11 is a top view of a dial valve that can be used to control cycling frequency.

FIG. 11 depicts an adjustment device 112 that permits for the frequency of the oscillations created by the cycling of the valve 12 to be adjusted. The adjustment device 112 controls the level of vacuum, or the airwatts, of the vacuum device by introducing atmospheric air into the inner chamber 32 of the nozzle assembly 10. A dial valve 112 can be provided for this purpose to control flow coming into the inner chamber 32 of the nozzle assembly 10. A higher inner chamber 32 air pressure lowers the cycling frequency, which permits the speed of the oscillating sanding pad 102 or brush 20 to be adjusted. This, in turn, controls the cycling frequency of the valve 12. The dial valve 112 can be opened and closed to adjust the amount of airflow permitted into the inner chamber 32. The dial valve 112 is shown positioned on an upper surface of the top cover 24 in FIG. 10 at the upper end of the inner chamber 32. The adjustment mechanism could be provided at other locations, such as on the side of the nozzle assembly 10 or lower on the top cover 24. Other adjustment devices may alternatively be utilized that permit the introduction of atmospheric air into the inner chamber 32.

Figure 12A:
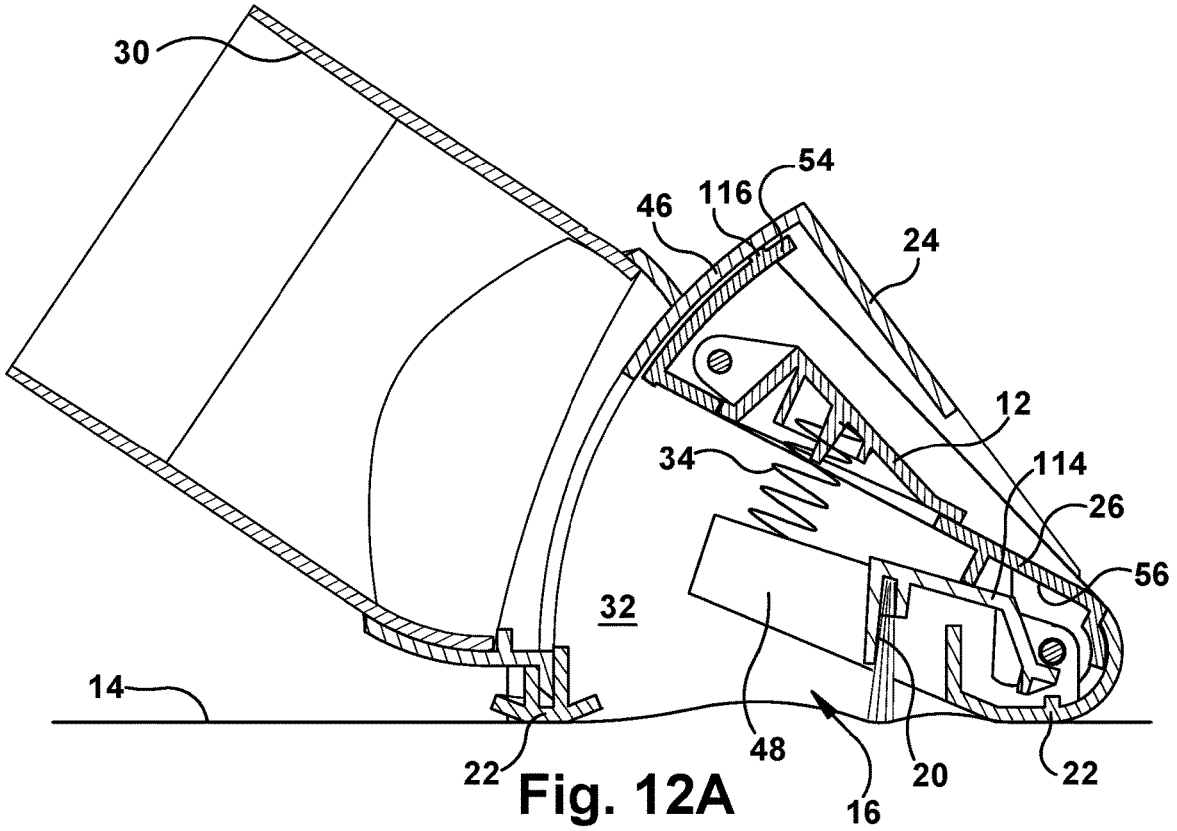
FIG. 12A is a cross-sectional side view of an alternative embodiment of the nozzle assembly device that has a translating brush mechanism for sweeping a surface, with the device in a first operational position.
Figure 12B:
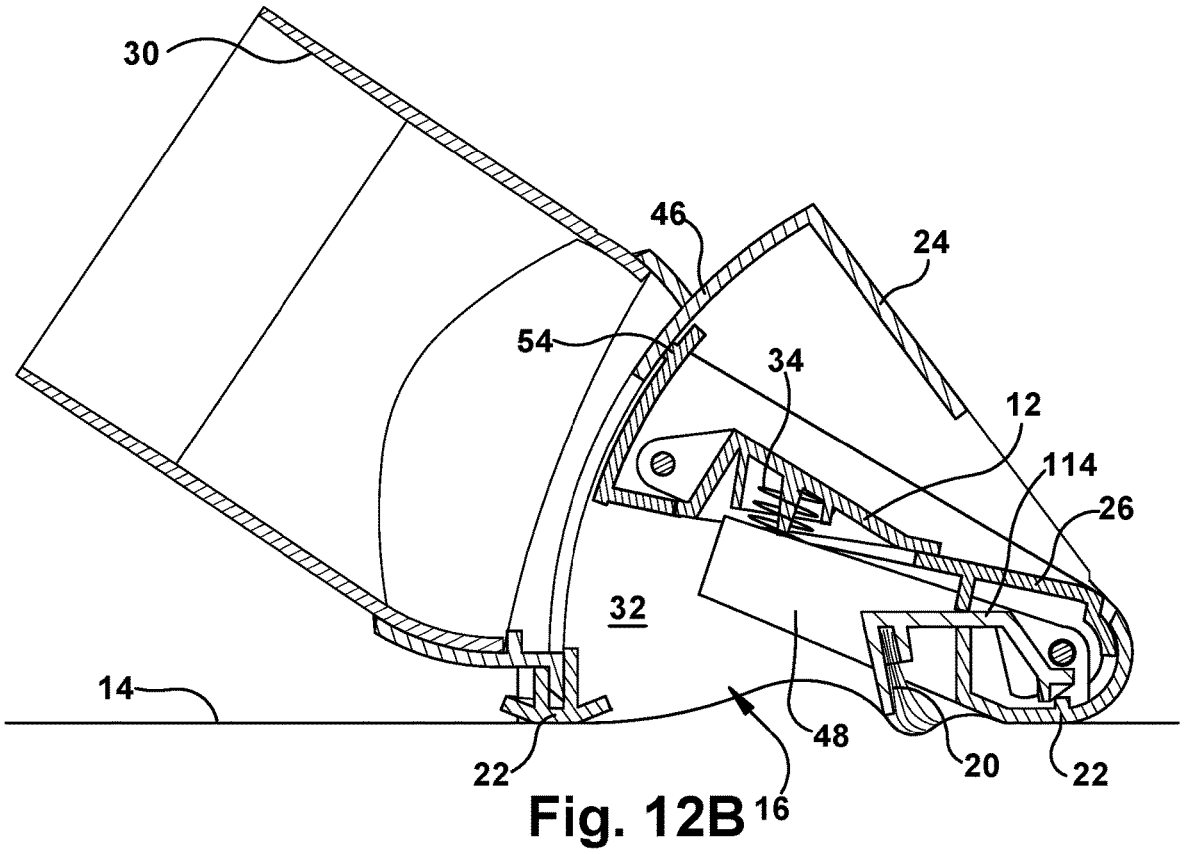
FIG. 12B is a cross-sectional side view of the embodiment of FIG. 12A, with the device in a second operational position.
Figure 12C:
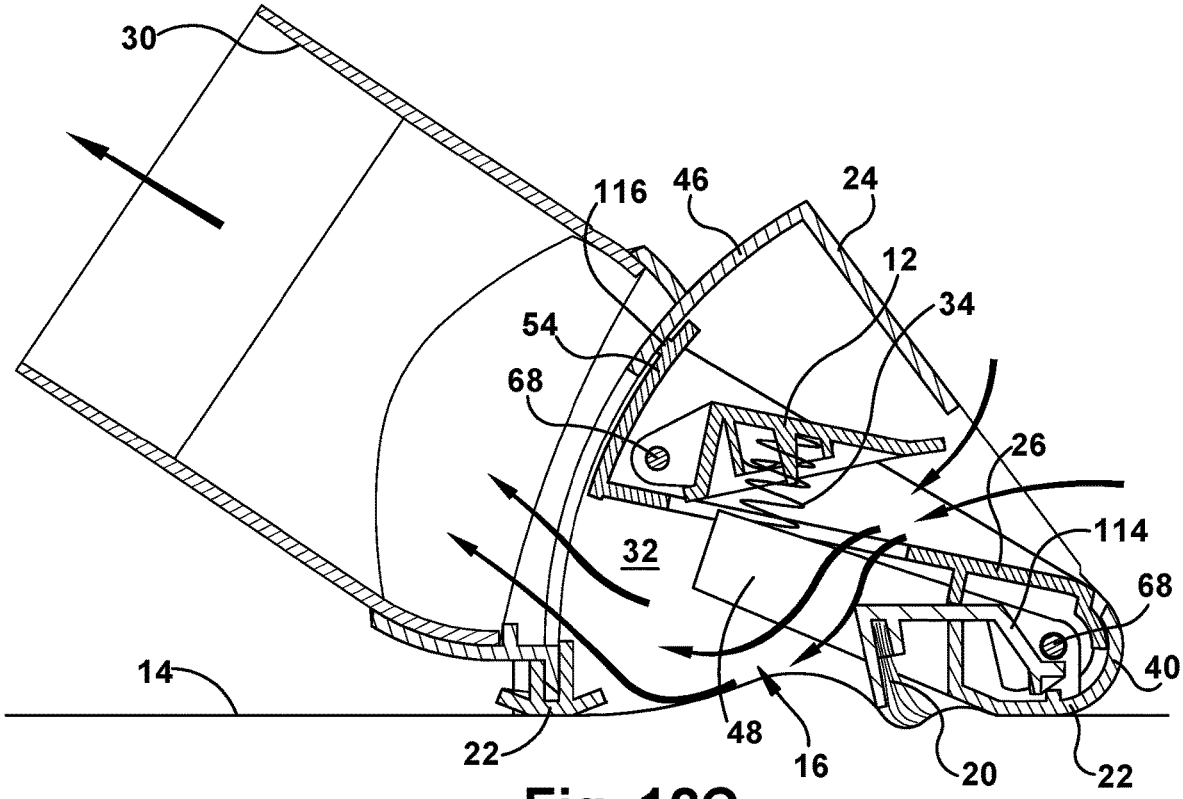
FIG. 12C is a cross-sectional side view of the embodiment of FIG. 12A, with the device in a third operational position where the valve is open.

FIGS. 12A-12C depict yet another embodiment of the invention that includes a brush 20 that is coupled to the motion of the diaphragm 26. This design utilizes a similar design to that shown in FIGS. 1-5. The brush 20 has a sweep stroke that is consistent with the movement of the diaphragm 26. The brush 20 includes an arm 114 that is positioned between an upper surface of the base member 22 and a lower surface 56 of the diaphragm 26. The arm 114 of the brush 20 is biased upwardly by a spring 36. The spring used to bias the arm 114 may be the same as the spring 36 that biases the diaphragm 26. As the diaphragm 26 moves upwardly and downwardly, the diaphragm 26 moves the brush 20 up and down, and forward and backward. Because the brush 20 is positioned on an arm 114, this causes the brush 20 to translate both up and down and substantially forwardly and rearwardly. The brush 20 and arm 114 are not permanently adhered to the diaphragm 26. They are formed as a separate part which could permit for the brush 20 to be removed and replaced, if desired.

The example nozzle assembly 10 could also be used in a water environment, such as an underwater pool environment. The fluid dynamic principles that apply to air would also apply in water to a pool cleaning embodiment. The nozzle assembly 10 could be used to vacuum water along with debris and the water could be returned to the pool after the debris is filtered from the water. In addition, a brush 20 or wheels could be driven by the linear motion or translational motion of the parts of the valve 12, which would aid in cleaning of the floor and walls of the pool.

If desired, the design may include a finger 98 that extends from the valve flap 12 that contacts the base member 22. As the diaphragm 26 rotates downwardly, the finger 98 contacts the base 22 and opens the valve flap 12 until the valve spring 34 force fully pops or opens the valve 12. This design would utilize the combination of the force from the finger 98 as well as the spring force to open the valve 12. Other designs may be utilized to optimize the opening and closing of the valve 12.

While a vacuum nozzle assembly 10 and various attachments are discussed above, other uses may be found for the nozzle 10 and valve 12 combination, such as any type of device that utilizes linear back and forth motion along with suction. For example, a cutting blade or hammer could be hooked to the nozzle assembly 10.

While a given nozzle/valve configuration was disclosed, other shapes and sizes for the various parts may be utilized. In addition, the various parts may be altered in shape to perform the same function. Other applications for the device are also possible and considered to be within the scope of this disclosure.

While a single valve flap 12 is shown and described, more than one valve flap 12 could be utilized. The valve flaps 12 could be positioned at different locations on the housing and/or diaphragm 26.

According to one embodiment of the invention, a nozzle assembly 10 for use with a vacuum source includes a base member 22, a top cover member 24, a diaphragm 26, a valve flap 12, one or more diaphragm springs 36, one or more valve springs 34, and an internal cavity 32. The base member 22 defines a suction opening 16 for communicating with the vacuum source. The top cover member 24 has an outer wall for at least partially enclosing an interior of the nozzle assembly 10. The diaphragm 26 is rotationally coupled to the base member 22 and includes an opening extending therethrough. The valve flap 12 is rotationally coupled to the diaphragm 26 and has an opened position and a closed position. The valve flap 12 covers the opening 62 in the diaphragm 26 when in a closed position. One or more diaphragm springs 36 are positioned between the base member 22 and the diaphragm 26. One or more valve springs 34 are positioned between the base member 22 and the valve flap 12. The internal cavity 32 is defined below the diaphragm 26 and above the base member 22. In operation, the valve flap 12 is normally biased open and the diaphragm 26 is normally biased at an upper position within the housing. Pressure forces inside the internal cavity 32 compete with forces associated with atmospheric pressure acting on the valve flap 12 and diaphragm 26 and the force of the diaphragm 26 and valve springs 34 to continuously open and close the valve flap 12 in rapid succession during operation of the vacuum device.

The diaphragm springs 36 and the valve springs 34 may be coil springs. The diaphragm 26 may be rotationally coupled to an upper surface of the base member 22 at the front end thereof. The valve flap 12 may be rotationally coupled to an upper surface of the diaphragm 26 at a rear end thereof.

At least one of the base member 22 and the top cover member 24 may include an opening 30 coupled to the vacuum source for permitting vacuumed air, dirt and debris from the internal cavity 32 of the nozzle assembly 10 to enter an attached vacuum device.

In another embodiment, a nozzle assembly 10 for use with a vacuum device includes a housing, a diaphragm 26, a valve flap 12, and a plurality of springs 34, 36. The housing is for contacting an underlying surface 14 to be vacuumed. The housing has a suction opening 16 in communication with an internal cavity 32 defined in the housing. The diaphragm 26 is rotationally coupled to the housing and positioned adjacent the internal cavity 32. The valve flap 12 is rotationally coupled to the diaphragm 26 or the housing adjacent the internal cavity 32. The valve flap 12 is sized and shaped to cover an opening 62, 88 provided in the diaphragm 26 or housing. The plurality of springs 34, 36 are positioned between the diaphragm 26, valve flap 12 and housing, with at least a diaphragm spring 36 biasing the diaphragm 26 in an upper or lower direction and at least one valve spring 34 biasing the valve flap 12 in an open or closed position. The diaphragm 26 and the valve flap 12 are substantially rigid or rigid. The diaphragm 26 and valve flap 12 cycle continuously between a valve open and a valve closed position to create agitation and vibration of the underlying surface 14. The diaphragm 26 and valve do not strike the underlying surface 14.

The housing may include a base member 22 that abuts an underlying surface 14 and a top cover 24 that at least partially encloses an upper end of the housing. The diaphragm 26 may be positioned between the base member 22 and the top cover 24 and the valve flap 12 may be positioned between the diaphragm 26 and the top cover 24. The diaphragm 26 may include an opening 62 extending therethrough, with the valve flap 12 positioned over the opening 62 and completely covering the opening 62 when in the closed position.

The diaphragm 26 may be rotationally coupled to a front end 40 of the base member 22. The valve flap 12 may be rotationally coupled to a rear end 54 of the diaphragm 26. The one or more valve springs 34 may be positioned between the base member 22 and the valve flap 12 and the one or more diaphragm springs 36 may be positioned between the base member 22 and the diaphragm 26.

The diaphragm 26 may be positioned between the base member 22 and the top cover 24. The valve flap 12 may be coupled to an external wall 90 of the housing and is spaced from the diaphragm 26, but in communication with the diaphragm 26 via at least one of said plurality of springs 34. 36.

The one or more diaphragm springs 36 may be positioned between the base member 22 and the diaphragm 26 at a front end of the base member 22. The one or more valve springs 34 may be positioned between the valve flap 12 and the diaphragm 26 at a rear end of the diaphragm 26. The valve flap 12 may include at least one inwardly extending finger 98 that abuts the one or more valve springs 34.

The diaphragm 26 may be rotationally coupled to a front end of the housing. The diaphragm 26 may include an opening 62 extending therethrough. The valve flap 12 may be positioned below the opening 62 in the diaphragm 26 and is sized and shaped to close the opening 62 in the diaphragm 26 when the valve flap 12 is in the closed position. The valve flap 12 may be normally biased into an open position.

The valve flap 12 may be rotationally coupled to a rear end of the diaphragm 26 such that a rear end of the valve flap 12 pivots around an axis 92 defined at the rear end of the diaphragm 26. The one or more diaphragm springs 36 controls at least in part the movement of the diaphragm 26 and the one or more valve springs 34 may control at least in part the movement of the valve flap 12. The one or more diaphragm springs 36 may be torsion springs or coil springs, and the one or more valve springs 34 may be torsion springs or coil springs.

The nozzle assembly 10 may further include a brush 20 coupled to the diaphragm 26. The brush 20 may be one of fixedly coupled to the diaphragm 26 or rotationally coupled to the diaphragm 26. The brush 20 may translate forwardly and rearwardly as the diaphragm 26 moves along a sweeping stroke.

The nozzle assembly 10 may further include a sanding pad 102 coupled to the diaphragm 26 and the housing. The sanding pad 102 may translate forwardly and rearwardly as the diaphragm 26 moves inside the nozzle assembly 10.

The nozzle assembly 10 may further include an adjustment mechanism 112 for adjusting the airflow into the internal cavity 32 of the nozzle assembly 10. The adjustment mechanism may include a dial 114.

In yet another embodiment, a nozzle assembly 10 for use with a vacuum device includes a housing 22, 24, a diaphragm 26, and a valve flap 12. The housing 22, 24 has a suction opening 16 in communication with an inner chamber 32 defined in the housing. The diaphragm 26 is movably positioned inside the housing near the inner chamber 32. The diaphragm 26 has a first surface area defined by an outer perimeter of the diaphragm. The diaphragm 26 has an opening 62 extending therethrough for communicating air from the inner chamber 32 to the atmosphere around the housing 22, 24. A perimeter of the opening 62 defines a second surface area. The valve flap 12 is coupled to the diaphragm 26 and has a surface area at least large enough to partially or entirely close the opening 62 in the diaphragm 26. The valve flap 12 is movable between an open and closed position to open and close the opening 62 in the diaphragm 26. The diaphragm 26 has the first surface area when the valve flap 12 is closed and a third surface area equal to the first surface area minus the second surface area when the valve flap 12 is open. Movement of the diaphragm 26 and valve flap 12 inside the housing 22, 24 is caused by a combination of an imbalance in air pressures between the internal chamber and the atmosphere surrounding the housing, and the change in surface area between the first surface area and the third surface area.

The valve flap 12 may alternatively have a surface area to at least in part cover the opening 62 in the diaphragm, such that the valve flap 12 may not entirely cover the opening 62 in the diaphragm 26. The valve flap 12 is movable between an open and closed position to open and partially or fully close the opening in the diaphragm 26. The vacuum can still pick up dirt and debris even if the opening 62 through the diaphragm 26 is not completely covered as long as the vacuum force is great enough to operate the valve flap 12.

The housing may have a top cover 24 that is integral with the base member 22. The base member forms the bottom end of the integral top cover and base member. The base member 22 portion of the housing, in this instance, would be the bottom part of the housing, including the part that touches the underlying surface 14. Moreover, if the top cover and base member are independently claimed elements, they could be combined to be a single element if the base member 22 is integral with the top cover 24.

The term "substantially," if used herein, is a term of estimation.

While various features are presented above, it should be understood that the features may be used singly or in any combination thereof. Further, it should be understood that variations and modifications may occur to those skilled in the art to which the claimed examples pertain. The examples described herein are exemplary. The disclosure may enable those skilled in the art to make and use alternative designs having alternative elements that likewise correspond to the elements recited in the claims. The intended scope may thus include other examples that do not differ or that insubstantially differ from the literal language of the claims. The scope of the disclosure is accordingly defined as set forth in the appended claims.

What is claimed is:

1. A nozzle assembly for use with a vacuum source comprising:

a base member defining a suction opening for communicating with the vacuum source;

a top cover member having an outer wall for at least partially enclosing an interior of the nozzle assembly;

a diaphragm rotationally coupled to the base member, said diaphragm including an opening extending therethrough;

a valve flap rotationally coupled to the diaphragm having an opened position and a closed position, said valve flap covering the opening in the diaphragm when in a closed position;

one or more diaphragm springs positioned between the base member and the diaphragm;

one or more valve springs positioned between the base member and the valve flap;

an internal cavity defined below the diaphragm and above the base member;

wherein, in operation, the valve flap is normally biased open and the diaphragm is normally biased at an upper position within the housing, and pressure forces inside the internal cavity compete with forces associated with atmospheric pressure acting on the valve flap and diaphragm and the force of the diaphragm and valve springs to continuously open and close the valve flap in rapid succession during operation of the vacuum device.

2. The nozzle assembly of claim 1, wherein the diaphragm springs and the valve springs are coil springs.

3. The nozzle assembly of claim 1, wherein the diaphragm is rotationally coupled to an upper surface of the base member at the front end thereof, and the valve flap is rotationally coupled to an upper surface of the diaphragm at a rear end thereof.

4. The nozzle assembly of claim 1, wherein at least one of the base member and the top cover member include an opening coupled to the vacuum source for permitting vacuumed air, dirt and debris from the internal cavity of the nozzle assembly to enter an attached vacuum device.

5. A nozzle assembly for use with a vacuum device comprising:

a housing for contacting an underlying surface to be vacuumed, said housing having a suction opening in communication with an internal cavity defined in the housing;

a diaphragm rotationally coupled to the housing and positioned adjacent the internal cavity;

a valve flap rotationally coupled to the diaphragm or the housing adjacent the internal cavity, said valve flap sized and shaped to cover an opening provided in the diaphragm or housing;

a plurality of springs positioned between the diaphragm, valve flap and housing, with at least a diaphragm spring biasing the diaphragm in an upper or lower direction and at least one valve spring biasing the valve flap in an open or closed position;

wherein the diaphragm and the valve flap are substantially rigid or rigid, the diaphragm and valve flap cycle continuously between a valve open and a valve closed position to create agitation and vibration of the underlying surface, and the diaphragm and valve do not strike the underlying surface.

6. The nozzle assembly of claim 5, wherein the housing includes a base member that abuts an underlying surface and a top cover that at least partially encloses an upper end of the housing.

7. The nozzle assembly of claim 6, wherein the diaphragm is positioned between the base member and the top cover and the valve flap is positioned between the diaphragm and the top cover, and the diaphragm includes an opening extending therethrough, with the valve flap positioned over the opening and completely covering the opening when in the closed position.

8. The nozzle assembly of claim 7, wherein the diaphragm is rotationally coupled to a front end of the base member and the valve flap is rotationally coupled to a rear end of the diaphragm; with one or more valve springs being positioned between the base member and the valve flap and one or more diaphragm springs positioned between the base member and the diaphragm.

9. The nozzle assembly of claim 6, wherein the diaphragm is positioned between the base member and the top cover, and the valve flap is coupled to an external wall of the housing and is spaced from the diaphragm, but in communication with the diaphragm via at least one of said plurality of springs.

10. The nozzle assembly of claim 9, wherein one or more diaphragm springs are positioned between the base member and the diaphragm at a front end of the base member, and one or more valve springs are positioned between the valve flap and the diaphragm at a rear end of the diaphragm.

11. The nozzle assembly of claim 10, wherein the valve flap includes at least one inwardly extending finger that abuts the one or more valve springs.

12. The nozzle assembly of claim 5, wherein the diaphragm is rotationally coupled to a front end of the housing, the diaphragm includes an opening extending therethrough, and the valve flap is positioned below the opening in the diaphragm and is sized and shaped to close the opening in the diaphragm when the valve flap is in the closed position, with the valve flap being normally biased into an open position.

13. The nozzle assembly of claim 12, wherein the valve flap is rotationally coupled to a rear end of the diaphragm such that a rear end of the valve flap pivots around an axis defined at the rear end of the diaphragm.

14. The nozzle assembly of claim 13, wherein one or more diaphragm springs controls at least in part the movement of the diaphragm and one or more valve springs controls at least in part the movement of the valve flap, with the one or more diaphragm springs being torsion springs or coil springs, and the one or more valve springs being torsion springs or coil springs.

15. The nozzle assembly of claim 12, further comprising a brush coupled to the diaphragm, wherein the brush is one of fixedly coupled to the diaphragm or rotationally coupled to the diaphragm.

16. The nozzle assembly of claim 15, wherein the brush translates forwardly and rearwardly as the diaphragm moves along a sweeping stroke.

17. The nozzle assembly of claim 12, further comprising a sanding pad coupled to the diaphragm and the housing, wherein the sanding pad translates forwardly and rearwardly as the diaphragm moves inside the nozzle assembly.

18. The nozzle assembly of claim 5, further comprising an adjustment mechanism for adjusting the airflow into the internal cavity of the nozzle assembly.

19. The nozzle assembly of claim 18, wherein the adjustment mechanism includes a dial.

20. A nozzle assembly for use with a vacuum device comprising:

a housing having a suction opening in communication with an inner chamber defined in the housing;

a diaphragm movably positioned inside the housing in the vicinity of the inner chamber, said diaphragm having a first surface area defined by an outer perimeter of the diaphragm, with the diaphragm having an opening extending therethrough for communicating air from the inner chamber to the atmosphere around the housing, the perimeter of the opening defining a second surface area; and a valve flap coupled to the diaphragm and having a surface area to at least in part cover the opening in the diaphragm, with the valve flap being movable between an open and closed position to open and partially or fully close the opening in the diaphragm, wherein the diaphragm has the first surface area when the valve flap is closed and a third surface area equal to the first surface area minus the second surface area when the valve flap is open; and wherein movement of the diaphragm and valve flap inside the housing is caused by a combination of an imbalance in air pressures between the internal chamber and the atmosphere surrounding the housing, and the change in surface area between the first surface area and the third surface area.

* * * * *